US011773679B2

(12) United States Patent
Cherewyk et al.

(10) Patent No.: US 11,773,679 B2
(45) Date of Patent: Oct. 3, 2023

(54) WELLBORE SLEEVE INJECTOR AND METHOD

(71) Applicant: ISOLATION EQUIPMENT SERVICES INC., Red Deer (CA)

(72) Inventors: Boris (Bruce) P. Cherewyk, Calgary (CA); Edward St. George, Red Deer (CA)

(73) Assignee: Isolation Equipment Services, Inc., Red Deer (CA)

( * ) Notice: Subject to any disclaimer, the term of this patent is extended or adjusted under 35 U.S.C. 154(b) by 0 days.

(21) Appl. No.: 17/667,063

(22) Filed: Feb. 8, 2022

(65) Prior Publication Data

US 2022/0195827 A1 Jun. 23, 2022

Related U.S. Application Data

(63) Continuation of application No. 16/544,487, filed on Aug. 19, 2019, now Pat. No. 11,280,151.

(30) Foreign Application Priority Data

Aug. 17, 2018 (CA) ..... CA 3014973

(51) Int. Cl.

| | |
|---|---|
| ***E21B 33/068*** | (2006.01) |
| ***E21B 43/26*** | (2006.01) |
| ***E21B 23/04*** | (2006.01) |
| ***E21B 33/12*** | (2006.01) |
| ***E21B 33/124*** | (2006.01) |
| ***E21B 17/10*** | (2006.01) |
| ***E21B 34/10*** | (2006.01) |

(52) U.S. Cl.
CPC ..... *E21B 33/068* (2013.01); *E21B 17/1078* (2013.01); *E21B 34/101* (2013.01); *E21B 33/124* (2013.01); *E21B 43/2607* (2020.05)

(58) Field of Classification Search
USPC ..... 166/75.15
See application file for complete search history.

(56) References Cited

U.S. PATENT DOCUMENTS

| | | | | |
|---|---|---|---|---|
| 7,234,525 | B2 * | 6/2007 | Alves | E21B 33/068 166/310 |
| 9,103,183 | B2 * | 8/2015 | He | E21B 33/068 |
| 10,287,844 | B2 * | 5/2019 | Johnson | E21B 43/2607 |
| 2018/0313182 | A1 * | 11/2018 | Cherewyk | E21B 33/068 |
| 2019/0153795 | A1 * | 5/2019 | Johnson | E21B 34/142 |
| 2019/0368301 | A1 * | 12/2019 | Eitschberger | E21B 33/068 |

* cited by examiner

*Primary Examiner* — Matthew Troutman
*Assistant Examiner* — Douglas S Wood

(57) ABSTRACT

An apparatus, system, and method are provided for injecting carrier sleeves into a wellbore. The injection system is capable of individually indexing a selected sleeve from a sleeve magazine into an injector bore and axially aligning the sleeve with the bore with a retaining device. The retaining device prevents a subsequent sleeve from being indexed into the bore from the magazine. The selected sleeve can be restricted from free fall using a staging mechanism, which can subsequently be opened to permit the selected sleeve to fall into a staging bore. The staging bore is then fluidly isolated from the injector bore and the wellbore, pressure in the staging bore is equalized with the wellbore, and then opened to the wellbore for injecting the sleeve into the wellbore. The sleeve can be axially aligned and radially centered with the injector bore using a tapered portion in the bore or the staging mechanism.

16 Claims, 22 Drawing Sheets

WELLBORE SLEEVE INJECTOR AND METHOD

CROSS-REFERENCE TO RELATED APPLICATIONS

This application is a continuation of U.S. patent application Ser. No. 16/544,487, filed Aug. 19, 2019, which claims the benefit of Canadian Patent application Serial No. 3,014,973, filed Aug. 17, 2018, the entirety of each of which are incorporated herein by reference.

FIELD

Embodiments disclosed herein generally relate to the injection of actuators into a wellbore for operating downhole devices used in wellbore fracturing operations. More particularly, embodiments herein relate to apparatus and systems for introducing a plurality of carrier sleeves into a wellbore.

BACKGROUND

Treatment of a wellbore includes fracturing or the introduction of other stimulation fluids to the wellbore by selectively isolating zones of interest in the hydrocarbon-bearing formation along the wellbore. Devices such as packers and sliding sleeves are used to selectively direct the treatment fluids to the selected zone. Treatment fluids, such as fracturing fluids, are then pumped down the wellbore and into the formation.

It is typically desired to stimulate multiple zones by introducing a sequence of actuators such a balls, darts, or carrier sleeves. In one technique, a completion string accessing the formation is fit with a plurality of spaced sliding sleeves or other downhole devices that are individually and selectively actuable to open the string to the formation at the selected, isolated zone. It is known to drop a sequence of balls to selectively engage one of the sliding sleeves at the selected zone in order to block fluid flow thereat and hydraulically actuate communication to the formation. Once the selected zone has been stimulated, a subsequent ball is dropped to actuate a subsequent sleeve uphole of the previously actuated sleeve, for isolation and stimulation thereabove. The process is continued until all the desired zones have been stimulated.

Typically the balls range in diameter from a smallest ball, suitable to engage a small seat of the downhole-most sleeve, ranging upwardly is size to a largest diameter ball, suitable for engaging the uphole-most sleeve. A known disadvantage of ball-drop methods includes the wellbore-restricting ball seats remaining in the completion string, thus restricting pump rates therethrough during treatment or fracturing and production rates thereafter.

As an alternative method to dropping balls into downhole devices such as sleeves or packers, carrier sleeves with balls preloaded therein can be dropped into the wellbore. The carrier sleeves for an operator are characterized by a consistent internal bore, regardless of how many carrier sleeves are sent downhole. Each carrier sleeve has an outer latch that is configured to correspond to a profile in the downhole device. Indexing the axial length or axial configuration of the latch and profile provides selective device control, each different latch/profile located at a different zone. The ball supported in the carrier sleeve blocks fluid flow thereby as before to actuate the downhole device to permit access via a port into the selected zone uphole from the carrier sleeve for subsequent treatment. A plurality of carrier sleeves are required for engaging subsequent and corresponding downhole device profiles. The balls within the carrier sleeves can be releasable or dissolvable for subsequent removal and clearing of the wellbore.

The use of carrier sleeves provides the treatment operator with advantages, including a consistent diameter along the length of the wellbore, which in turn enables larger treatment volumes, less fluid friction, a longer horizontal leg, and greater production.

Carrier sleeves are typically injected manually, one by one. At surface, the wellbore is fit with a wellhead including valves and a treatment fluid connection block, such as a frac header. Treatment fluid, including sand, gels, and acid treatments are injected via the frac header at high pressure and fluid flow rates into the wellbore. The wellhead has a generally vertical axial bore through which the carrier sleeves are introduced. As applicant understands the conventional practice, operators manually introduce sleeves to the wellbore, one by one, through a tee-configuration. An operator isolates the tee at a lower end from the wellhead, and introduces one carrier sleeve into the tee from an upper end. The tee is closed in and a pumping source pressurizes the tee before opening the lower end of the tee to the wellhead for release of the sleeve to the wellbore below.

Methods and apparatus exist that allow for the sequential injection of a multiplicity of carrier sleeves. An example of a sleeve injection apparatus is found in US Patent Publication no. 2018/0313182 A1, the entirety of which is incorporated herein by reference. Such apparatus can comprise a plurality of sleeves stored in a magazine or other storage device and individually introduced into the axial bore of the wellhead to be dropped into the wellbore. Staging mechanisms, such as a dual isolation valve configuration downhole from the sleeve magazine, can be present on the wellhead stack to isolate the sleeve magazine from wellbore pressure. To provide for more control over the injection of a selected sleeve, and reduce the sleeve's falling velocity and subsequent impact force on an upper isolation valve, a retaining mechanism, such as an annular retaining ring, can be located in the axial bore below the sleeve magazine and above the uppermost of the isolation valves. The retaining mechanism acts to arrest the fall of the sleeve. A tubular or cylindrical guide rod can extend into the axial bore from the top of the wellhead to push the selected sleeve past the retaining mechanism and towards the dual isolation valves. The selected sleeve can then be injected into the wellbore after pressure equalization procedures have been performed using the dual isolation valves or other means.

It is also known to use mechanically or hydraulically-actuated, or spring-biased, push arms in the sleeve magazine to push the carrier sleeves into the axial bore. Such push arms can also be used to prevent a sleeve introduced into the axial bore from falling towards the wellbore by continuing to apply a force on the sleeve to push it into the wall of the axial bore, only releasing the sleeve and allowing it to fall when it is desired to inject the sleeve into the wellbore.

While such apparatus and methods permit the sequential injection of multiple carrier sleeves, sleeves can become axially misaligned with the axial bore when being introduced/indexed thereto and become stuck while falling towards the wellbore, for example on isolation valves, the retaining mechanism, and the like. Additionally, the use of a guide rod on the wellhead introduces additional bulk and complexity, resulting in increased maintenance and service requirements, as well as making accessing the axial bore more difficult. Further, the use of push arms in the sleeve magazine to hold a sleeve up against the axial bore can be problematic, as a sleeve subsequent to the selected sleeve can also be inadvertently introduced, or partially introduced, into the wellbore, which can obstruct the path of the guide rod and interfere with injection operations. Correcting such an obstruction requires manual removal, which is time consuming.

There is a need for a safe and efficient apparatus and mechanism for introducing a plurality of sleeves into a wellbore while reducing complexity of the injector and the risk of a sleeve becoming stuck while falling towards the wellbore.

SUMMARY

Embodiments of a sleeve injector and system are disclosed herein for selectively injecting carrier sleeves, used for actuating compatible downhole devices in a wellbore, into the wellbore. The sleeves are supplied from one or more sleeve-containing magazines, and injected through a fluid staging bore into the wellbore. The selected carrier sleeve is indexed and axially aligned in an injector bore of an injector by a retaining device and restricted therein from free fall by a staging mechanism, remaining in the injector bore until the staging mechanism is actuated to an open position. The selected sleeve then falls into a staging bore of a staging block below the injector, the injector bore and staging bore forming part of a contiguous axial bore of the wellhead stack that is selectively isolated from the wellbore. The staging mechanism can be configured to completely clear the injector bore in the open position, or axially align and radially center the sleeve in the bore. The retaining device can block or otherwise prevent indexing of a subsequent sleeve from the sleeve magazine until launch of the selected sleeve is completed. In embodiments, the retaining device can be configured to axially align carrier sleeves with the injector bore when the sleeves are introduced into the bore.

Once the selected sleeve falls into the staging bore, the staging bore is fluidly isolated from the injector bore and the pressure therein is equalized with the wellbore. Once pressure equalization is complete, the staging bore is opened to the wellbore for injecting the sleeve therein. The staging bore can be selectably isolated from the injector bore and wellbore by corresponding upper and lower isolation valves. Further, the staging bore can be pressure-equalized and the fluid level therein managed for impact protection of the components and carrier sleeves.

As the sleeve injector is always isolated from the wellbore in normal operations, the magazines can be maintained at atmospheric pressure, and maintained fluidly isolated from well pressure, enabling viewing access to the carrier sleeves via a window or other opening of the magazines to confirm the selected sleeves and injection thereof.

Sleeve injection verification devices, such as a camera, trip lever, and/or acoustic sensor can also be provided for confirming that the selected sleeve was successfully launched or injected into the wellbore. The acoustic sensor may also be used to confirm receipt of the carrier sleeve downhole in the wellbore at the corresponding sleeve-actuated device.

Embodiments of a sleeve injection apparatus, system, and method herein are advantageous as axial alignment of a carrier sleeve with the injector bore as it is introduced therein, and as it falls toward the wellbore, reduce the likelihood of the sleeve becoming stuck on debris or other structures in the axial bore.

In a general aspect, a sleeve injector for injecting carrier sleeves into an axial bore of a wellhead contiguous with a wellbore having sleeve-actuated devices therein, comprises an injector head adapted to be supported by the wellhead, the injector head having an injector bore therethrough in fluid communication with the axial bore; at least one sleeve magazine having an open end in communication with the injector bore, the at least one magazine storing at least one sleeve, each of the at least one sleeve magazine having an actuator operable for introducing a selected sleeve of the at least one sleeve into the injector bore; at least one retaining device extending radially into the injector bore, each retaining device substantially opposing the open end of a corresponding one of the at least one sleeve magazine and configured to actuate between a retracted position and a retaining position; and at least one staging mechanism adapted to actuate between a staging position, in which the staging mechanism obstructs the injector bore for retaining the selected sleeve within the injector bore, and an open position, in which the staging mechanism permits the selected sleeve to fall towards the wellbore.

In an embodiment, the at least one staging mechanism comprises at least one staging pin that extends radially into the injector bore in the staging position, and substantially clears the injector bore in the open position.

In an embodiment, the sleeve injector further comprises a tapered portion located in the injector bore uphole of the at least one staging mechanism, an inner diameter of the tapered portion decreasing towards the wellbore for axially aligning and radially centering the selected sleeve with the injector bore as it falls therethrough.

In an embodiment, the at least one staging mechanism comprises a gate having an aperture formed therethrough; wherein in the open position, the aperture of the gate is substantially aligned with the injector bore and permits the selected sleeve to pass therethrough; and wherein in the staging position, the aperture of the gate is misaligned with the injector bore.

In an embodiment, the aperture of the gate is tapered towards the wellbore for axially aligning and radially centering the selected sleeve with the injector bore as it falls therethrough.

In an embodiment, each of the at least one staging mechanism is located at a different axial location along the injector bore and configured to accommodate sleeves of varying heights.

In an embodiment, a head portion is located at a sleeve-engaging end of the at least one retaining device, the head portion having a concave sleeve-engaging face for axially aligning the selected sleeve with the injector bore.

In an embodiment, the concave sleeve-engaging face has a curvature that generally corresponds with an outer diameter of the selected sleeve.

In an embodiment, the head portion is interchangeable for accommodating various sleeve weights and outer diameters.

In an embodiment, a stroke distance of the retaining device is adjustable for accommodating various sleeve weights outer diameters.

In an embodiment, the sleeve injector further comprises at least one sleeve injection verification device.

In an embodiment, the at least one verification device comprises a camera located in the injector bore and configured to acquire still image or video data of the injector bore.

In an embodiment, the at least one sleeve injector indicator comprises at least one trip lever having a bore end and an indicator end, the trip lever rotatably mounted to the injector head such that the bore end extends radially into the injector bore, and the indicator end is visible from the exterior of the injector; wherein the trip lever is adapted to actuate from a resting position to a triggered position in response to the selected sleeve engaging the bore end as it falls towards the wellbore; and wherein the trip lever is biased towards the resting position.

In an embodiment, the injector head further comprises one or more rotating collars configured to permit sleeves to be introduced into the injector bore from a selected magazine of the at least one magazine while preventing sleeves from being introduced into the injector bore from remaining magazines of the at least one magazine; and the one or more rotating collars each having a slot sized to permit sleeves to individually pass therethrough, and having a protrusion to permit the one or more rotating collars to be manipulated.

In another general aspect, a method of injecting carrier sleeves into a wellbore comprises retaining at least one sleeve in at least one sleeve magazine with a retaining device; actuating the retaining device to a retracted position; introducing a selected sleeve of the at least one sleeve into an injector bore of an injector head; obstructing the injector bore below the at least one magazine with a staging mechanism for holding the selected sleeve in the injector bore; fluidly connecting the injector bore with a staging bore located below the injector bore; actuating the staging mechanism to an open position for permitting the selected sleeve to fall into the staging bore; fluidly isolating the staging bore from the injector bore; pressurizing the staging bore; and fluidly connecting the staging bore to the wellbore to inject the selected sleeve into the wellbore.

In an embodiment, the method further comprises axially aligning the selected sleeve with the injector bore using the retaining device.

In an embodiment, the step of actuating the staging mechanism to the open position further comprises actuating the staging mechanism to fully clear the injector bore.

In an embodiment, the step of actuating the staging mechanism to the open position comprises aligning an aperture of the staging mechanism with the injector bore.

In an embodiment, the method further comprises verifying that the selected sleeve is held in the injector bore by the staging mechanism.

In an embodiment, the method further comprises axially aligning and radially centering the selected sleeve in the injector bore after the selected sleeve has been introduced into the injector bore.

BRIEF DESCRIPTION OF THE DRAWINGS

FIG. 1A illustrates the injector and wellhead with the retaining device and staging mechanism closed and a first selected carrier sleeve stored in a magazine;

FIG. 1B illustrates the injector and wellhead with the first selected carrier sleeve in the process of being indexed into the injector bore, and the retaining device actuated to a retracted position;

FIG. 1C illustrates the first carrier sleeve dropped onto the closed staging mechanism;

FIG. 1D illustrates the first carrier sleeve shown dropping past the opened staging mechanism into the staging block and then shown resting on a closed lower isolation valve in preparation for pressure equalization of the carrier sleeve in the staging block to the wellbore fracturing pressure in wellbore below;

FIG. 1E illustrates the carrier sleeve stored in the staging block with an upper isolation valve closed and the staging block being pressured up to wellbore pressure;

FIG. 1F illustrates the carrier sleeve injected into the wellbore through an opened lower isolation valve;

DESCRIPTION

Figure 1A:
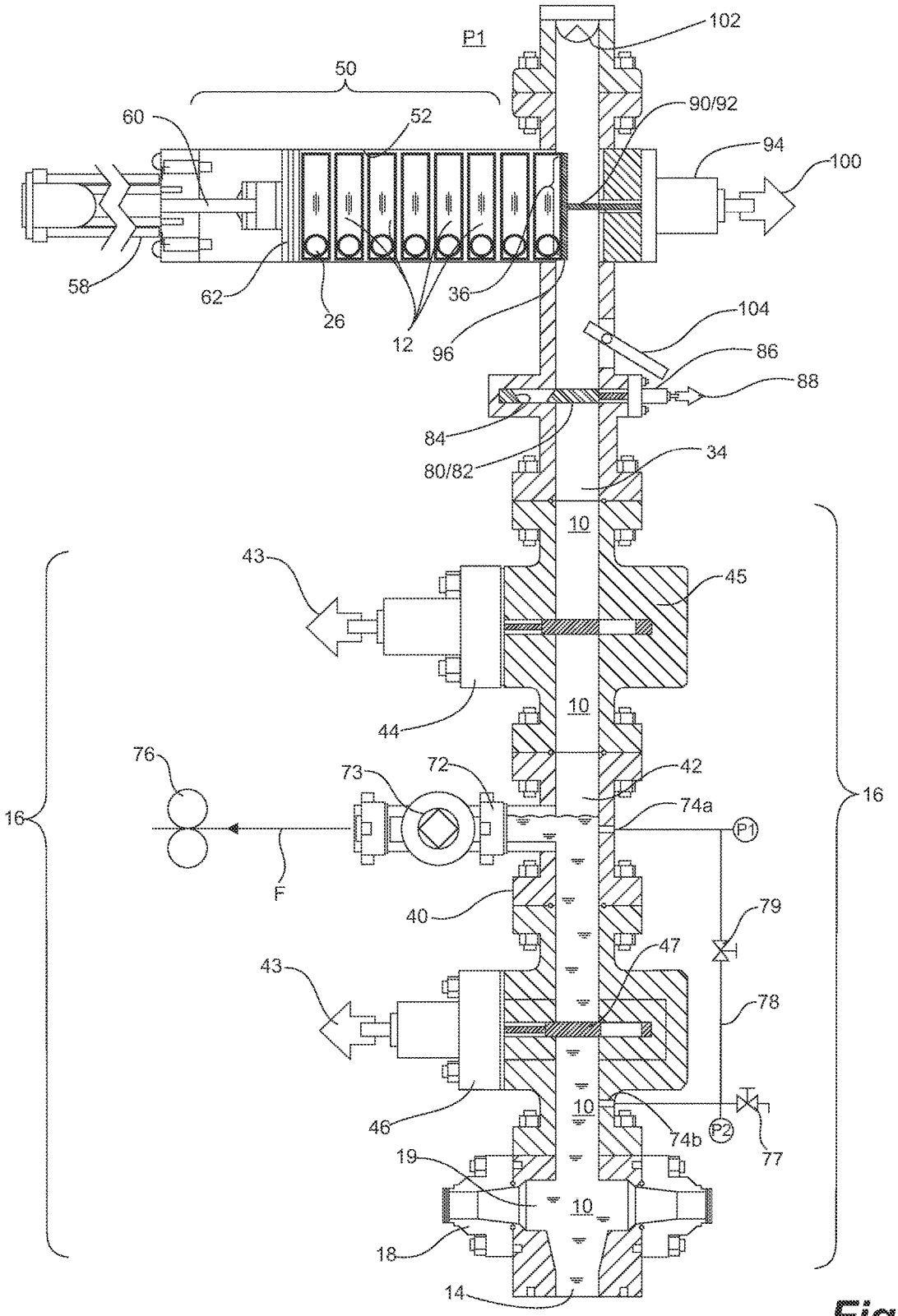
FIGS. 1A through 1F are partial side cross-sectional views of an injector and wellhead with carrier sleeves at various steps of the injecting process, the wellhead further comprising a sleeve retaining device and staging mechanism.

Generally, in accordance with embodiments described herein, an injector 30 and a system is provided for selectably and sequentially injecting carrier sleeves 12 into a wellbore 14 for isolating zones of interest during wellbore operations such as hydraulic fracturing. The injector 30 is supported on, and in fluid communication with, a wellhead 16 and is configured to inject carrier sleeves 12 from one or more magazines 50 connected thereto. The wellbore 14 has carrier sleeve-actuated devices positioned therealong. The injector 30 can be opened to atmosphere at atmospheric pressure P1, the wellhead 16 below being in fluid communication with the wellbore 14 at wellbore pressure P2. The wellhead 16 can include a frac head 18 below the injector 30 for receiving treatment fluid F, such as fracturing fluid, into a throughbore 19 and directing same into the wellbore 14 below.

The injector 30 comprises a staging mechanism 80 for staging a sleeved sleeve 12 and preventing said sleeve 12 from falling further downhole towards the wellbore 14 until the staging mechanism 80 is opened. In some embodiments, the staging mechanism 80 is configured to axially align and radially center the sleeve in an axial bore 10 of the wellhead 16. A retaining device 90 installed on the injector 30 is operable to restrain sleeves 12 from being introduced into the injector 30 until desired, and in some embodiments is capable of axially aligning sleeves 12 with the axial bore.

Figure 6:
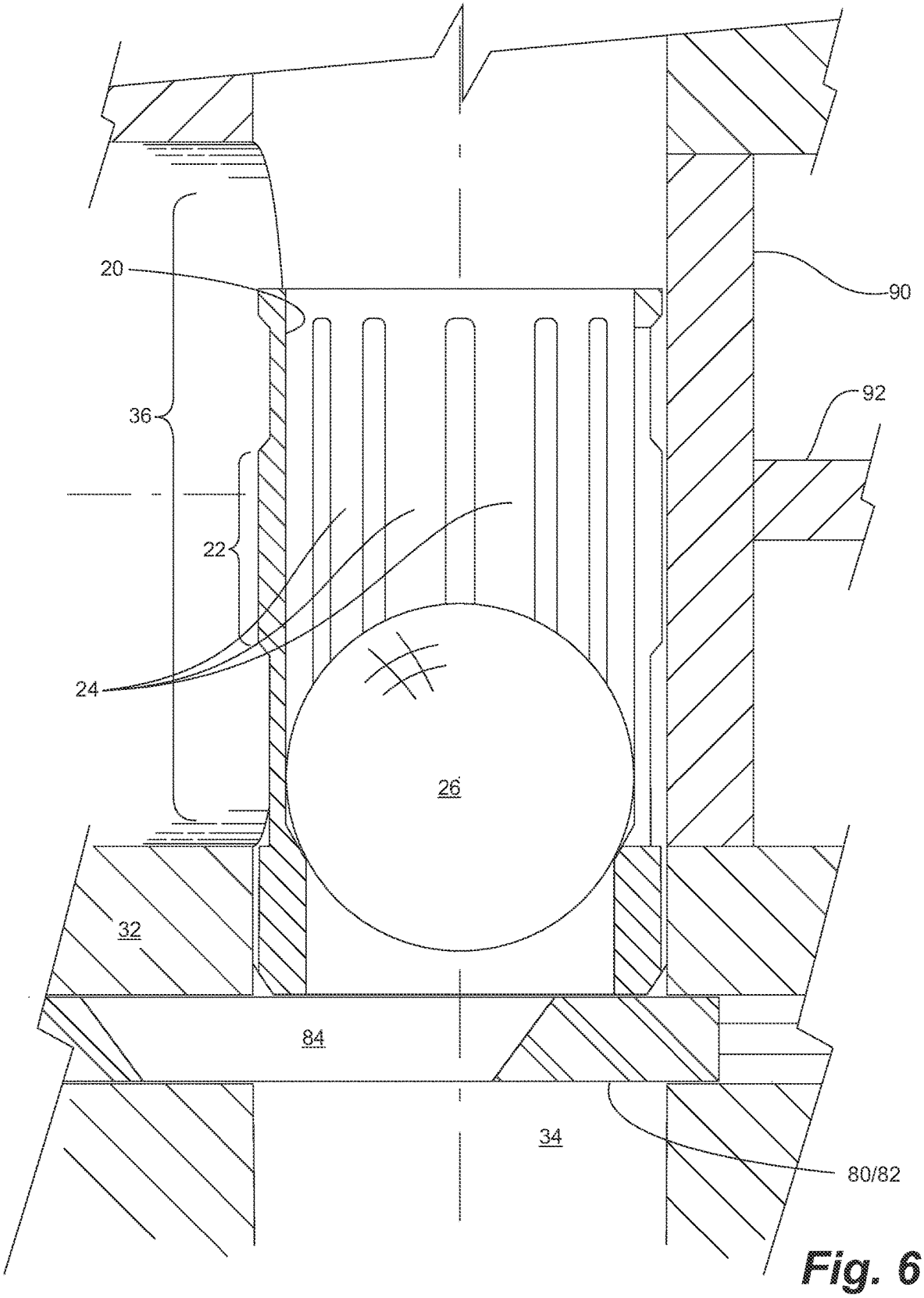
FIG. 6 is a close up side cross-sectional view of a typical carrier sleeve in the injector bore, supported on the staging mechanism in the closed staging position.

In embodiments herein, each sleeve 12 comprises a tubular body 20 having a bore-blocking ball 26 for temporarily blocking fluid flow therethrough. The ball 26 can be dissolvable to avoid a need to later drill through the ball so as to reestablish fluid flow in the wellbore. With reference to FIG. 6, a typical collet and ball-type carrier sleeve has a known length and outer diameter, each carrier sleeve having an external latch 22 corresponding to a downhole, carrier-actuated device, such as those spaced along the wellbore for accessing various zones of the wellbore 14. Each carrier sleeve 12 has an outer latch 22 that corresponds to a profile in the corresponding downhole device. The carrier sleeve 12 can include a collet 24 for spring loading the latch 22 outwardly to the device profile. The ball 26 supported therein blocks fluid from flowing thereby. The latch 22 will vary in configuration for engaging subsequent and corresponding downhole device profiles. The balls 26 can be releasable or dissolvable for subsequent removal and clearing of the wellbore.

In detail, with reference to FIGS. 1A-1G, embodiments of the sleeve injection system comprises the injector 30 having at least one magazine 50 for storing one or more carrier sleeves 12. One or more carrier sleeves 12 are stored inside the at least one magazine 50.

The injector 10 comprises an injector head 32 having an injector bore 34 extending therethrough. One or more sleeve apertures 36 can be formed in the injector head 32, each aperture 36 configured to receive a magazine 50. The magazines 50 are each connected to the injector head 32 and configured to sequentially deliver carrier sleeves 12 into the injector bore 34 through the sleeve apertures 36. The injector head 32 comprises a portion of the wellhead 16.

The wellhead 16 further comprises a staging block 40, having a staging bore 42 in communication with the injector bore 34, and located downhole from the injector head 32. The injector bore 34, staging bore 42 and frac head bore 19 and wellbore 14 are in fluid communication to form a common contiguous axial bore 10 of the wellhead 16. The axial bore 10 is selectively interrupted by upper and lower isolation devices 44,46, described in further detail below. Preferably, the staging bore 42 has sufficient axial height above the lower isolation valve 46 to accommodate all sizes of sleeves 12 to be used in the operation between the upper and lower isolation valves 44,46.

The upper isolation device 44 and lower isolation device 46 are located uphole and downhole of the staging block 40, respectively. The upper isolation device 44 and lower isolation device 46 are operable to selectively fluidly isolate the staging bore 42 from the injector bore 34 and the wellbore 14, respectively. In the depicted embodiments, upper and lower isolation devices 44,46 are isolation gate valves. Upper and lower isolation valves 44,46, such as gate valves having respective gates 45,47, are actuable between open and closed positions. Upper isolation valve 44 is operable to fluidly isolate injection bore 34 from staging bore 42 when in the closed position, and permit fluid communication therebetween when in the open position. Lower isolation valve 46 is operable to fluidly isolate the staging bore 42 from the wellbore 14 when in the closed position, and permit fluid communication therebetween when in the open position. When both upper and lower isolation valves 44,46 are in the closed position, the staging bore 42 is isolated from both the injection bore 34 and the wellbore 14, and can be pressured up or down as described in further detail below. One or both of the isolation valve gates 45,47 can have a resilient material applied to, or embedded in, their upper surfaces to reduce impact imparted to either a carrier sleeve 12 landing thereon, or the respective gate upon receipt of the sleeve 12. For example, the resilient material can be polytetrafluoroethylene (PTFE). The upper and lower isolation valves 44,46 can also have indicators 43 configured to display whether the valves are in the open or closed position.

The staging block 40 can further have a first fluid port 72 in communication with staging bore 42 through fluid port valve 73. One or more pumps 76 can be connected to first port 72 and configured to pump fluid into or out of the staging bore 42. The pump 76 can introduce fluid for pressurizing the staging bore 42, and for displacing a selected carrier sleeve 12 therein into the wellbore 14. Pump 76 can also be configured to de-pressurize, or drain fluid, from the staging bore 42 in advance of receiving a subsequent selected carrier sleeve 12.

Alternatively, an equalization conduit 78 can fluidly connect between a first equalization port 74*a* of the staging bore 42 to a second equalization port 74*b* located in the portion of the axial bore 10 below the lower isolation valve 46. In other words, the locations of the first and second equalization ports 74*a*,74*b* straddle the lower isolation valve 46. In an embodiment, the fluid port 72 and first equalization port 74*a*, both above the lower isolation valve 46, can be provided by a single port.

An equalization valve 79 can be located along the equalization conduit 78. The valve 79 is actuable between an open position for permitting equalization of the pressure in staging bore 42 to wellbore pressure P2 and a closed position for isolating the staging bore 42 from wellbore pressure P2.

A bleed port 77 formed in staging block 40 having a bleed valve can be used for depressurizing the staging bore 42 to atmospheric pressure P1 or for gravity drainage.

Magazines

Returning now to FIGS. 1A-1G, 3A, 3B, and 7, one or more magazines 50 can be mounted on the injector head 32. The magazines 50 comprise a magazine housing having a sleeve storage chamber 52 for storing one or more carrier sleeves 12. The magazine housing can be an elongated hollow body defining the storage chamber 52 having dimensions suitable for receiving and storing one or more carrier sleeves 12,12 in a generally side-by-side, upright orientation. An open end 54 of the magazine 30 can permit sleeves 12 to pass therethrough into or out of the storage chamber 52. When the magazine 50 is mounted on the injector head 32, the open end 54 of the storage chamber 52 is in communication with the injector bore 34 via a corresponding sleeve aperture 36 of the injector head 32, for delivery of carrier sleeves 12 into the bore 34.

Generally, the configuration of the carrier sleeves 12 are tubular, the diameter and length of which are standardized. The sleeve diameters are within a small range of variation due to the standardization of casing strings and wellheads. The magazines 50 can therefore also be standardized, or alternatively provided in dimensions specific to a completions operator's sleeve specifications. As the injector bore 34 to wellhead is standardized, and particularly for atmospheric magazines, various slightly different sized magazines 50 can be replaceably fit to the same injector head 32.

Figure 3A:
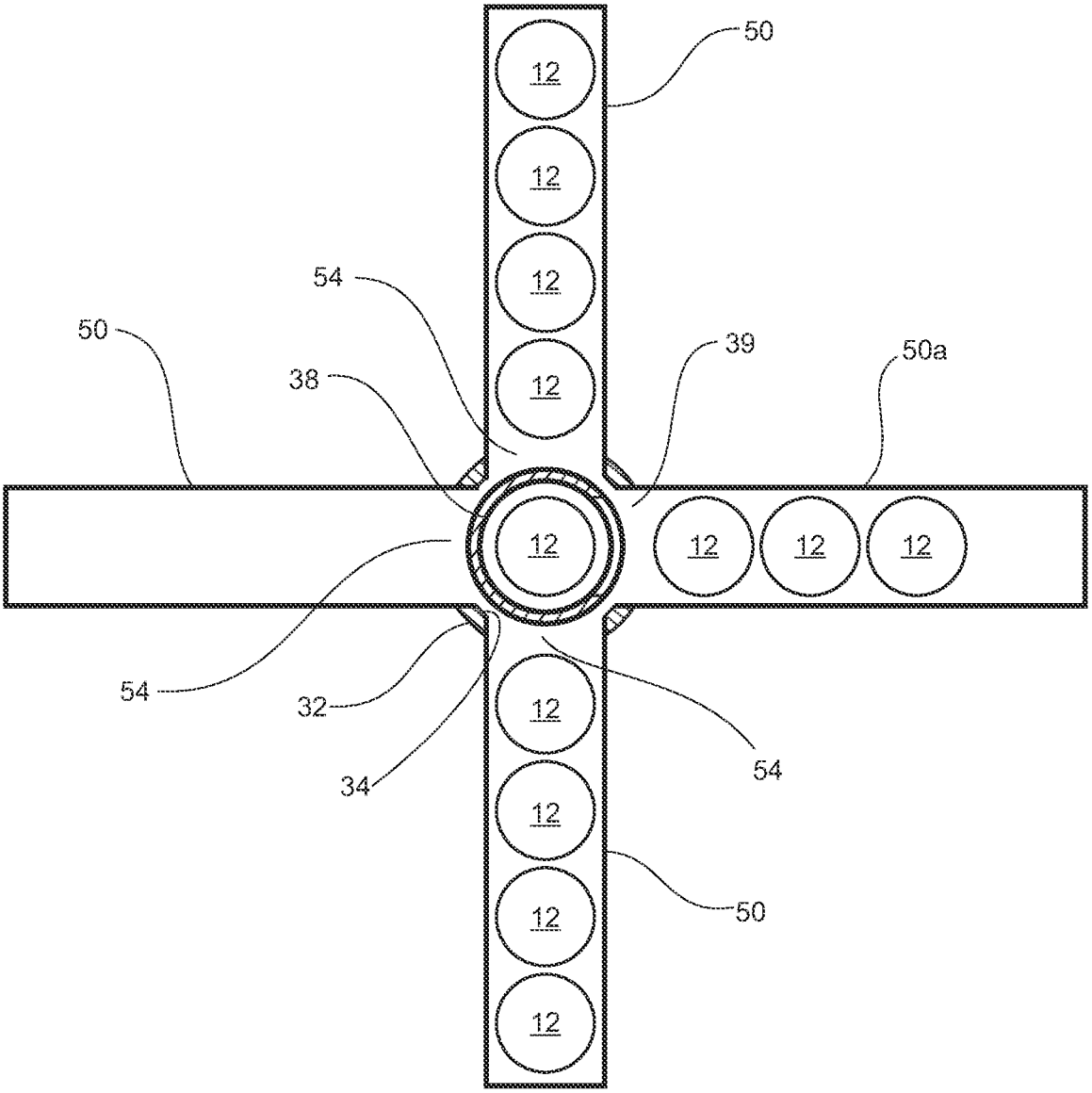
FIG. 3A illustrates a top cross-sectional view of a sleeve injector illustrating a rotating collar in the injector bore for aligning to a selected magazine of four magazines for receiving carrier sleeves therefrom, all of the magazines having carrier sleeves stored therein except for one.
Figure 3B:
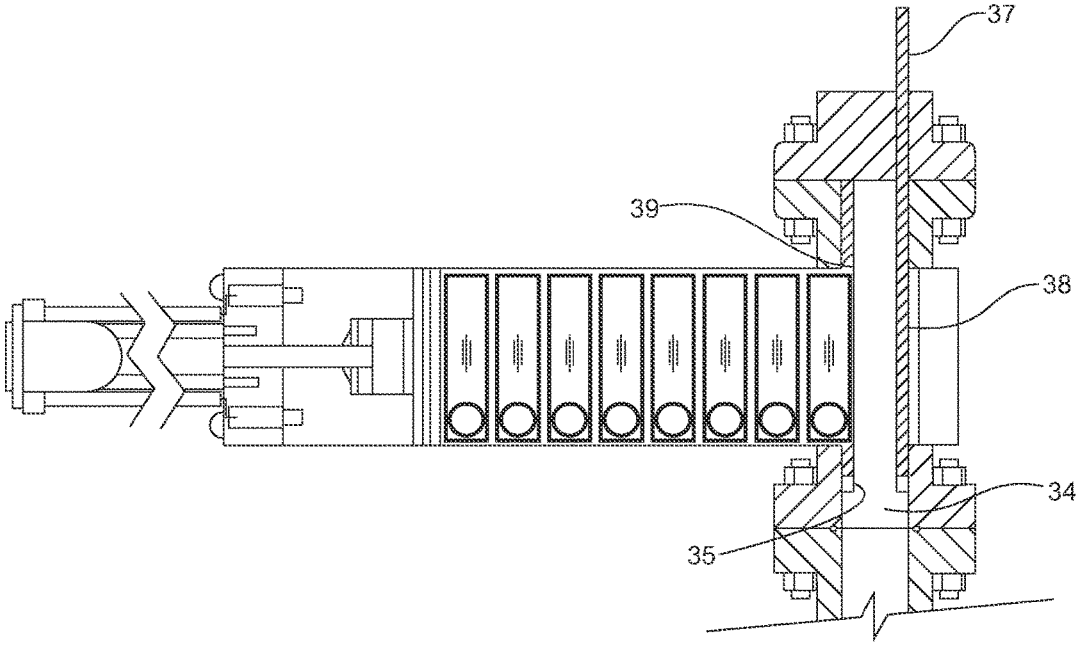
FIG. 3B is a partial side cross-sectional view of an injector having a rotating collar therein with a protrusion extending out of the uphole end of the injector for rotating the collar.
Figure 7:
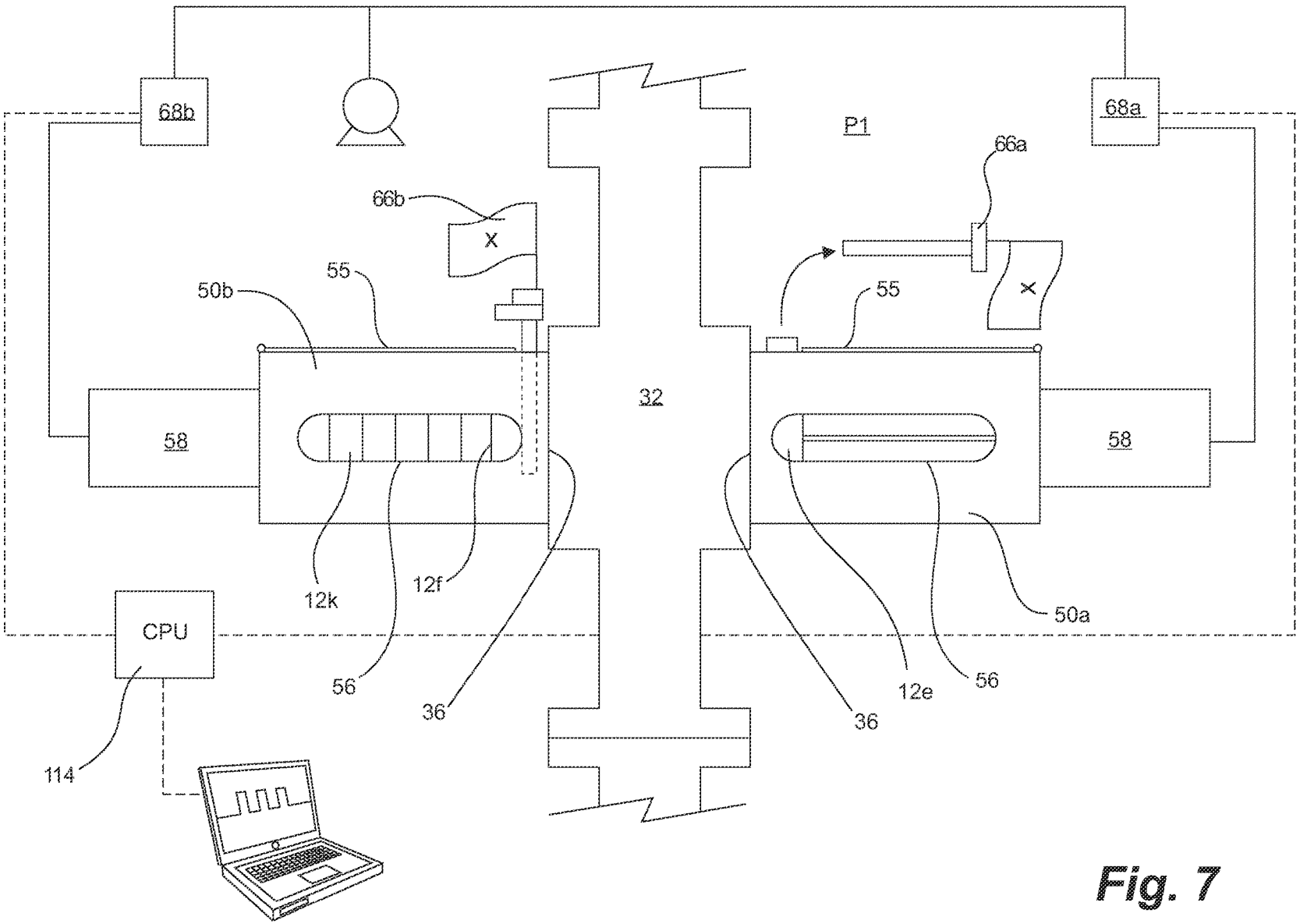
FIG. 7 is a schematic of a control system for selecting an active magazine of two magazines.

For minimizing operational delays, two or more or more magazines 50, 50 . . . can be installed on the injector head 32, the chambers 52 of each magazine 50 in communication with the injector bore 34 via corresponding sleeve apertures 36 of the injector head. With reference also to FIGS. 3A, 3B, and 7, the two or more magazines 50 can be circumferentially spaced around the injector head 32 at about the same axial position to form a magazine array. In embodiments, multiple magazine arrays can be installed on the injector head 32 at various axial positions to provide further additional capacity. Each magazine 50 can be removably and replaceably connected to the injector head 32 to permit loading of additional sleeves 12 in the magazines, such as through the open end 54 thereof, or the convenient changing of magazines 50. In some embodiments, the magazines 50 can have one or more access ports, hatches, or doors 55 for loading sleeves 12 into the magazine chambers 52 without the need to disconnect the magazines 50 from the injector head 32.

The magazines 50 can optionally comprise one or more indexing indicators, such as physical indicators or electronic sensors, to indicate the position, presence, or injection of sleeves 12. As the magazines 50 can be maintained at atmospheric pressure P1 during normal operations, a window or opening 56 (see FIG. 7) can be formed in the magazines 50, extending for substantially the length thereof to enable an operator to easily view the sleeves 12 stored within and their latch configuration. With a window 56 or open access, the sleeves 12 can be further colour or numerically-coded, labelled, or otherwise possess a visual indication to allow the operator to readily determine which sleeves will be injected into the wellbore, and track/record the sleeves 12.

The magazines 50 are configured to sequentially introduce sleeves 12 into the injector bore 34 for ultimate injection into the wellbore 14. With reference to FIGS. 1A-1G, the magazines 50 can each have an actuator 58 configured to drive the sleeves 12 towards the injector head 32. The actuator 58 can be a mechanical, electric, or hydraulic, linear actuator for urging the carrier sleeves 12 toward the injector bore 34. The actuator 58 can be operatively connected to an actuator rod 60 and a sleeve engaging head or plate 62 configured to drive the sleeves towards the injector bore 34. The actuators 58 can have indexed positions, such that sleeves 12 are individually introduced into the injector bore 34 as the actuator 58 progresses through each position. In other embodiments, the actuators 58 can simply apply a constant force on the array of sleeves 12, 12 . . . such that the sleeve 12 at the proximal end of the array is pushed through the sleeve aperture 36 as soon as the injector bore 34 is unobstructed. As will be described in further detail below, a retaining device 90 can be used to temporarily obstruct to sleeve aperture 36 to prevent sleeves 12 from being prematurely introduced into the injector bore 34.

Figure 4A:
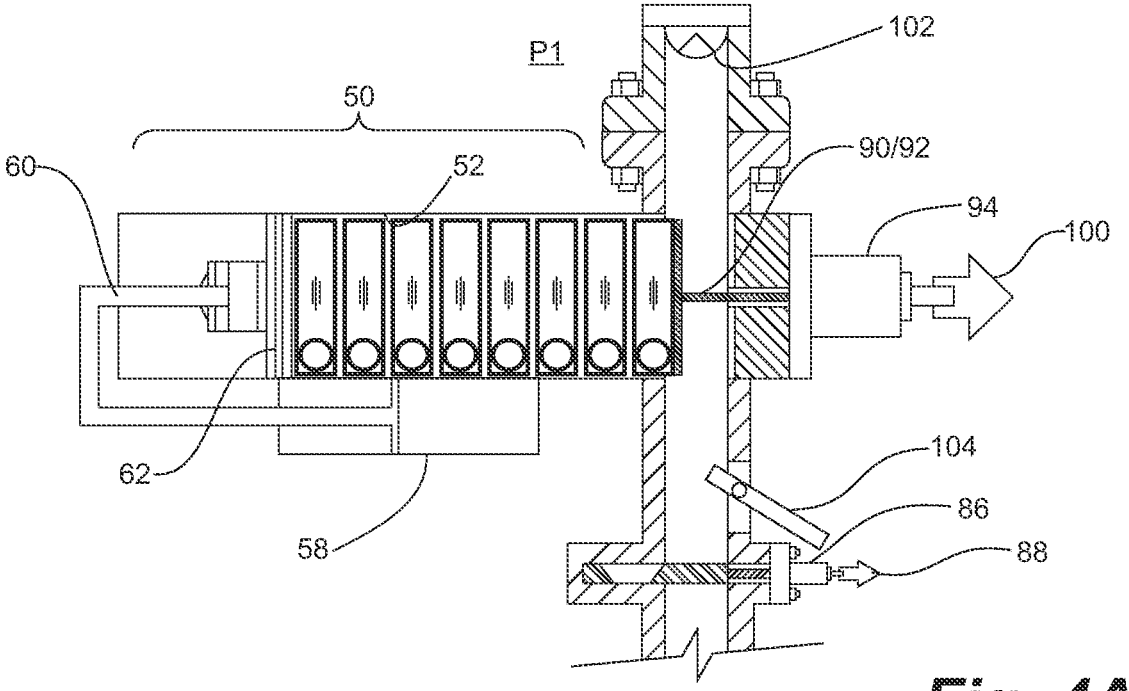
FIG. 4A is a partial side cross-sectional view of an embodiment of a wellhead having a magazine with a hydraulic actuator mounted underneath the magazine.

Actuator 58 can be operated manually or remotely. A person of skill in the art would understand that a remotely operated actuator 58 would typically comprise a double acting ram for hydraulic extension and hydraulic retraction, or an electric motor, coupled to a controller capable of receiving instructions and relaying them to the actuators 58. Each magazine 50 can have its own hydraulics/motor to avoid collision and ensure that the injector bore 34 is clear when required. In FIG. 1A the actuator 58 is a hydraulic actuator in line with the magazine's chamber 52 with linear extension indexing a sleeve 12 into the injector bore 34. In another embodiment, as shown in FIG. 4A, the actuator 58 can be mounted below the magazine 30 to save space, hydraulic retraction now advancing a sleeve 12. In a further alternative embodiment, the remotely operated actuator 58 can comprise an electric motor operated by a controller located at a location remote from the wellhead 16 and connected to the electric motor by an electrical cable, or via wireless means such as a cellular network, local wireless network, or the Internet.

Figure 4B:
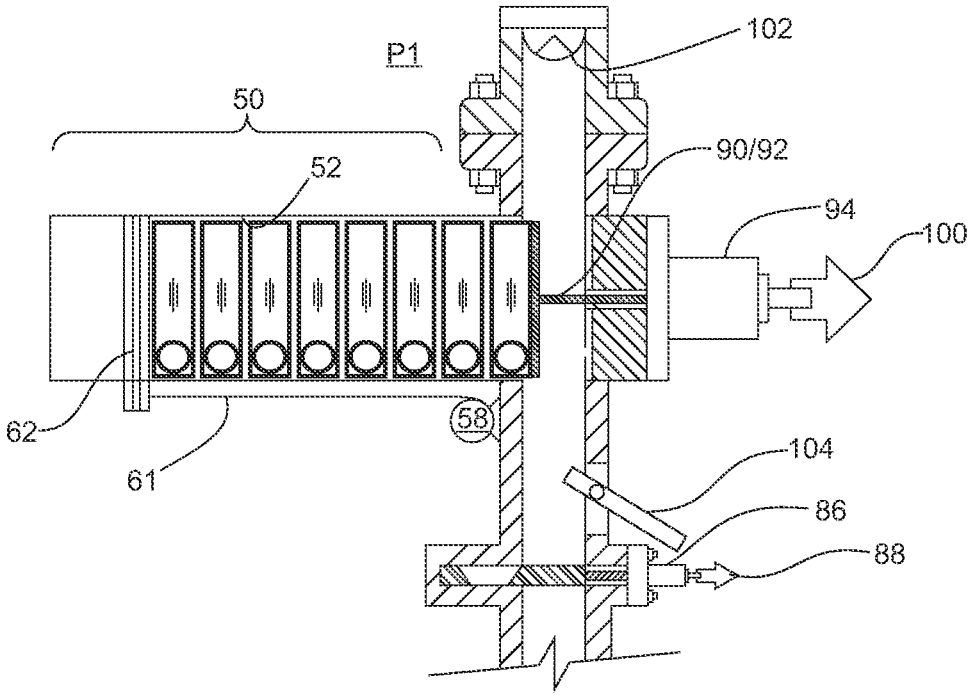
FIG. 4B is a partial side cross-sectional view of an embodiment of a wellhead having a magazine with a hydraulic winch mounted underneath the magazine.

In embodiments, as shown in FIG. 4B, the actuator 58 can be a winch, such as a hydraulic winch, connected to the sleeve engaging head 62 via a cable 61. The winch can be located on the injector head 32 or otherwise towards the proximal end of its respective magazine 50 toward the injector head such that retracting the winch pulls the sleeve engaging plate 62 towards the injector 30, thereby urging the sleeves 12 in the magazine 50 towards the injector bore 34.

Figure 5A:
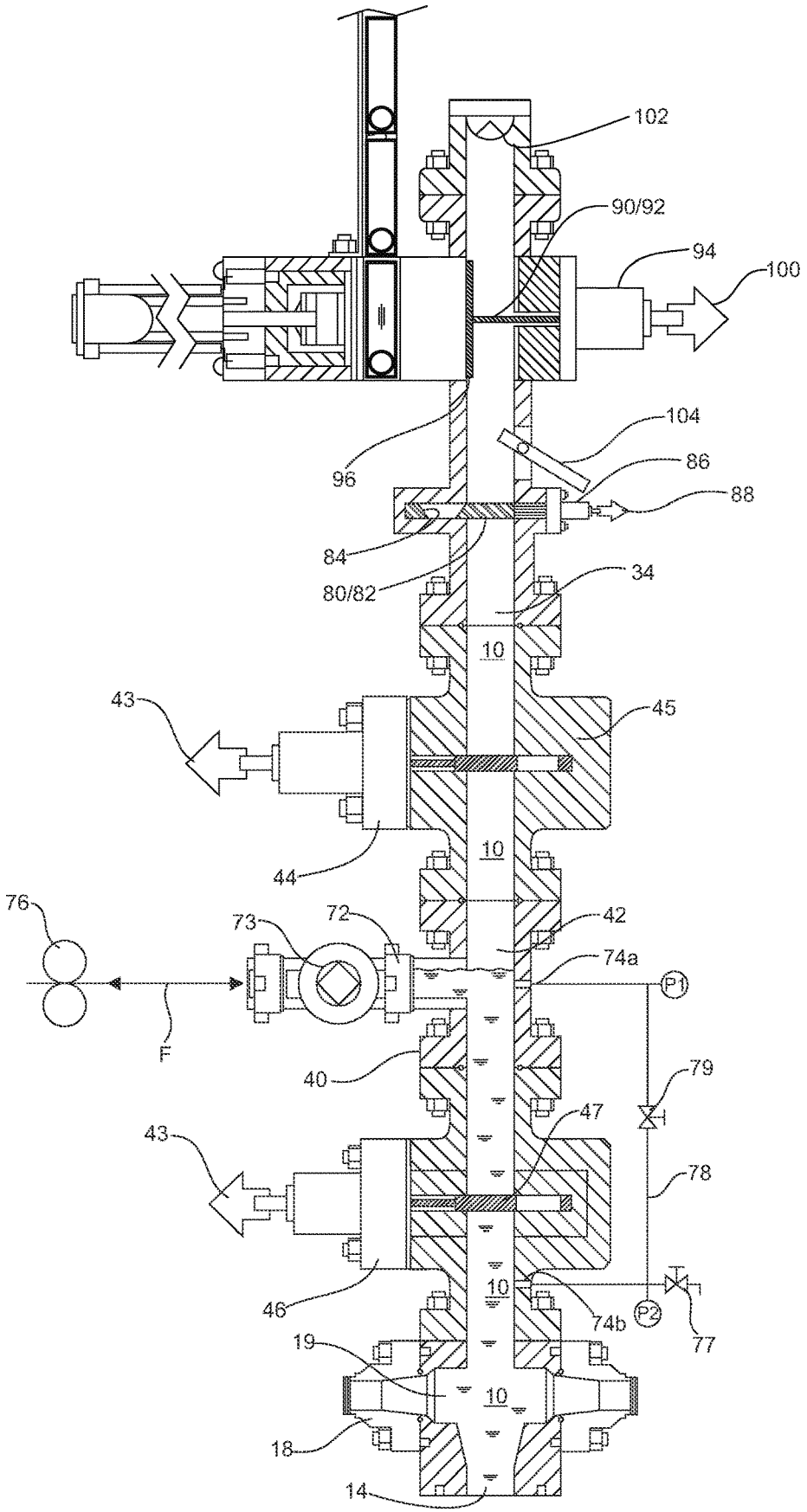
FIG. 5A is a side cross-sectional view of an alternative embodiment of a sleeve injector having a vertically-loaded magazine.
Figure 5B:
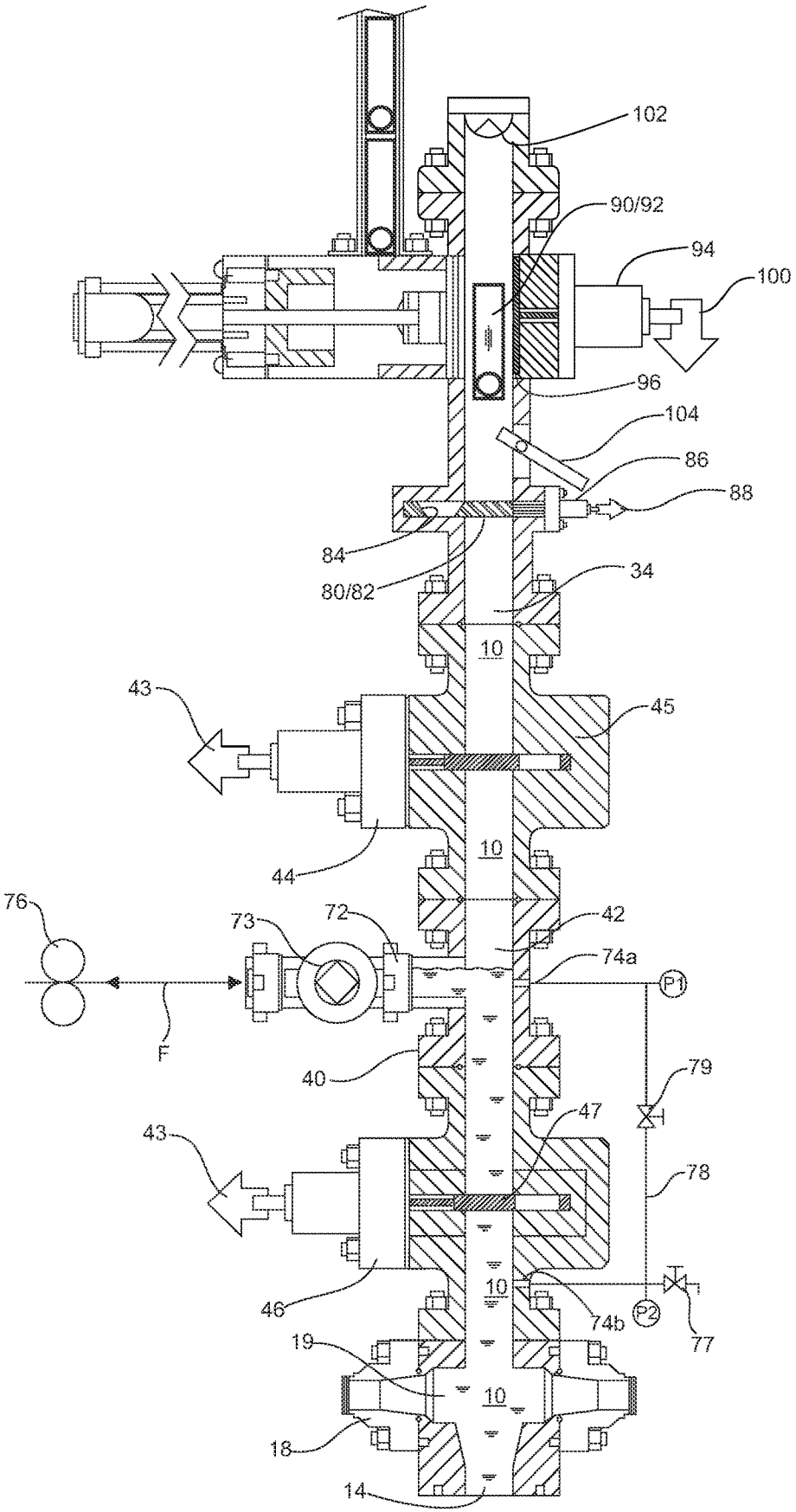
FIG. 5B is a side cross-sectional view of the embodiment of FIG. 5A showing the actuator having loaded a sleeve into the injector bore.

With reference to FIGS. 5A and 5B, in an alternative embodiment, the magazines 50 can be oriented generally vertically so as to enable gravity feeding of carrier sleeves 12. In FIG. 5A a single carrier sleeve 12*a* has been indexed from the vertically-loaded magazine 50 in-line with an actuator 58, such that the actuator 58 can actuate to index the sleeve 12*a* into the injector bore 34. In FIG. 5B, an actuator has introduced the selected sleeve 12*a* into the injector bore 34.

With reference to FIG. 7, in embodiments having multiple magazines 50, a safety restraint 66*a*, 66*b* such as a pin, plate, or other device known in the art can be located at the open end 54 of each magazine 50*a*, 50*b* respectively, or at the actuator 58, and configured to prevent untimely actuation of an inactive magazine 50*b*. When it is desired to inject sleeves 12 from a selected magazine 50*a*, the restraint 66*a* of that magazine can be disengaged. Restraints 66 can be manually actuated or remotely actuated, such as by electronic, mechanical, or hydraulic means.

As shown in FIGS. 3A and 3B, in embodiments, the restraint 66 can be a rotating collar 38 having a slot 39. The collar 38 can be located in the injector bore 34 at substantially the same axial location of the magazines 50 and be capable of aligning its slot 39 to a selected magazine 50*a* for receiving carrier sleeves 12 therefrom and isolating inactive magazines 50 from the injector bore 34. The rotating collar 38 comprises a tubular body having a slot 39 formed therein, the slot 39 configured to receive sleeves 12 from the selected magazine 50 when aligned with the selected magazine 50. The rotating collar 38 possesses an outer diameter that permits it to be located within the injector bore 34, and can be part of the injector head 32. For example, the collar 38 can rest on a radial shoulder or upset 35 extending inwardly from the injector bore 34.

When it is desired to inject sleeves 12 into the injector bore 34 from a selected magazine 50, the slot 39 of the collar 38 can be aligned with a selected magazine 50 such that the open ends 54 of the inactive magazines 50 are blocked and rendered inactive. For example, the injector head 32 can be designed with a 7" injector bore 34. A collar 38 with a 5" internal diameter and a 5" aperture or slot can be slid or installed axially inside the 7" bore of the injector head 32. The collar 38 is rotated to align the slot 39 with the selected magazine 50*a* loaded with respective packer sleeves having an outer diameter of 5" or less. Alternatively, the 7" collar 38 can be fit with more than one size slot 39 for alignment and selection of a particular size of carrier sleeve.

The collar 38 can be locked into angular position by set screws or any suitable mechanical device, or driven by a rotation mechanism set to rotate a given angular increment at a time to cycle between each of the magazines 50. For example, the rotation mechanism can be set to rotate a ¼ turn (90°) at a time to cycle through four equi-spaced magazines 50. When it is required to inject sleeves 12 from another magazine 50, the slotted collar 38 is rotated to align the slot 39 with it and locked into position. As best shown in FIG. 3B, a protrusion or lever 37 could extend out from the collar 38 and above the injector head 32 or otherwise in a matter accessible for an operator to quickly gain access for manual rotation of the collar 38 using a rotation mechanism from a distance. In embodiments, the collar 38 is remotely operable, such as via a hydraulic or electric actuator.

In embodiments, the collar 38 is interchangeable, such that collars 38 having different sized slots 39 for accommodating various sleeves 12 of different outer diameters can be used. To change collars 38, the operator can remove the collar 38 by sliding it out of the top of the wellhead 16 and inserting a new collar into the injector bore 34 via the top of the wellhead 16.

In embodiments with multiple axially-spaced magazine arrays, each magazine array can have a collar 38 associated therewith and configured to select a magazine 50 of the array for injecting sleeves 12 therefrom.

Alternatively, or additionally, the actuators 58 of inactive magazines 50 can be disabled to ensure that only sleeves 12 from the selected magazine 50 are introduced into the injector bore 34. As shown in FIG. 7, a hydraulic interlock 68*a*, 68*b* for each magazine 50*a*, 50*b*, can be provided connected to a central controller 70 capable of remotely directing which magazine 50 is to be selected. For embodiments having electric actuators 58, the actuators 58 of inactive magazines 50 can be switched to an inactive state until it is desired to inject sleeves 12 therefrom.

For example, referring still to FIG. 7, once all of the programmed sleeves 12 from a first magazine 50*a* (sleeves 12*a*-12*e* already launched downhole) have been injected into the wellbore 16, the mechanical or hydraulic restraint 66*b* from the second magazine 50*b* is released, for injection of sleeves 12*f*-12*k*. The restraint 66*a* for the first magazine 50*a* can be engaged, or its actuator 58*a* disabled at interlock 68*a*, to prevent the any additional sleeves 12 from being launched from magazine 50*a*.

Staging Mechanism

With reference to FIGS. 1A-1G, 6, 8A, 8B, and 10A-11B, the injector 30 and/or wellhead 16 can further comprise a staging mechanism 80 for staging the drop of a selected sleeve 12 after it is introduced into the injector bore 34.

Figure 8A:
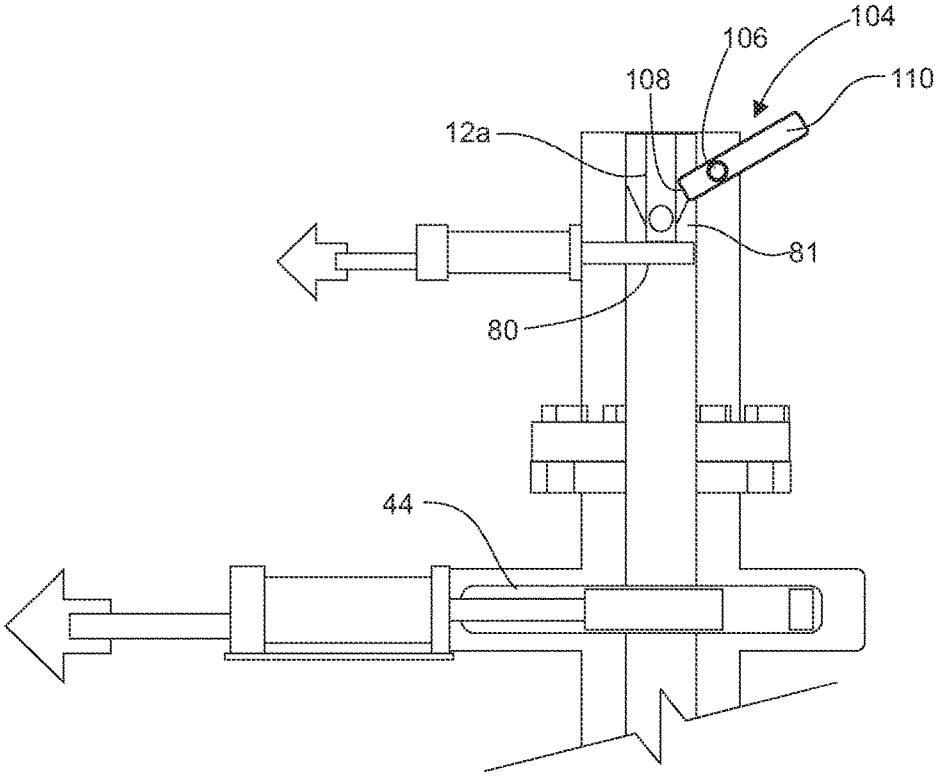
FIGS. 8A and 8B both illustrate partial side cross-sectional views of a portion of a wellhead from an injection bore down to an upper isolation valve having a staging mechanism above the upper isolation valve, and a trip lever located above the staging mechanism for indicating when a sleeve has arrived at the mechanism, and also when the sleeve has dropped therebelow.
Figure 8B:
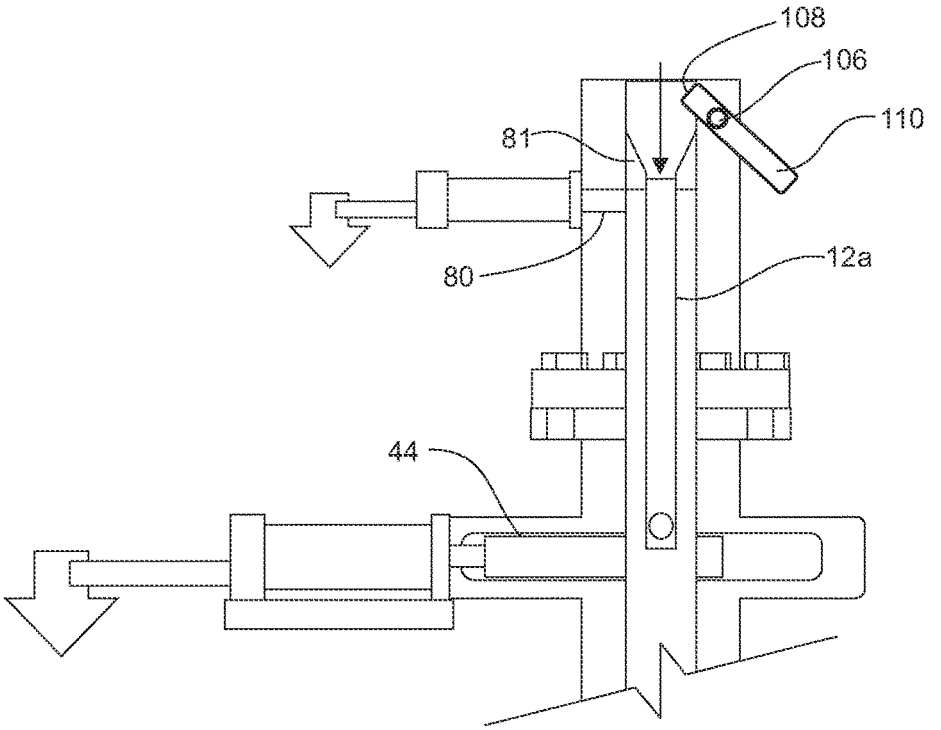
Figure 10A:
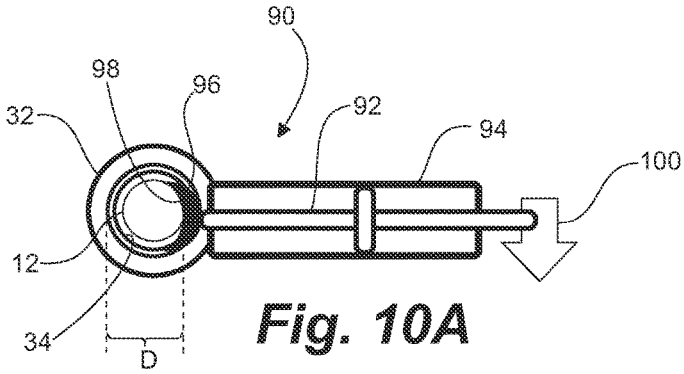
FIGS. 10A and 10B are partial side cross-sectional views of an injector head having a staging mechanism, the staging mechanism being in an open position in FIG. 11A and a closed staging position in FIG. 11B.
Figure 10B:
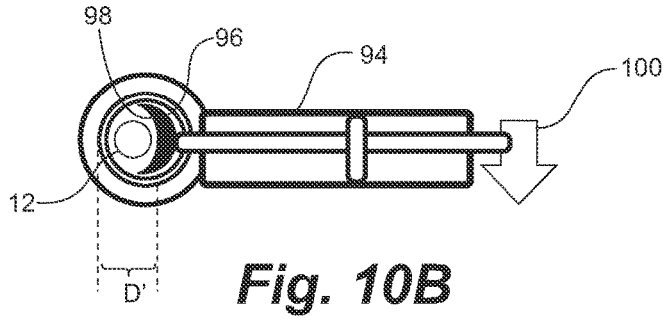

With reference to FIGS. 10A and 10B, the staging mechanism 80 can be a staging pin actuable between a closed staging position, wherein the pin extends into and/or across the injector bore 34 to obstruct the bore and prevent a sleeve 12 from falling further towards the wellbore 14, and an open position, wherein the pin 80 clears the injector bore 34 and permits a sleeve 12 to fall thereby. In embodiments, as shown in FIG. 10B, the staging mechanism 80 completely clears the injector bore 34 when in the open position, thus presenting no protrusions or other structures upon which a sleeve can become stuck while falling towards the wellbore 14. With reference to FIGS. 8A and 8B, a tapered portion 81 can be located uphole of, and adjacent to, the staging mechanism 80 for axially aligning and radially centering the sleeve 12 with the injector bore 34 as it passes thereby towards the staging mechanism. The tapered portion 81 can be made of, or lined with, a friction-reducing material such as PTFE, such that it does not interfere with the downhole progress of the sleeve 12 as it falls towards the staging bore 42.

Figure 11A:
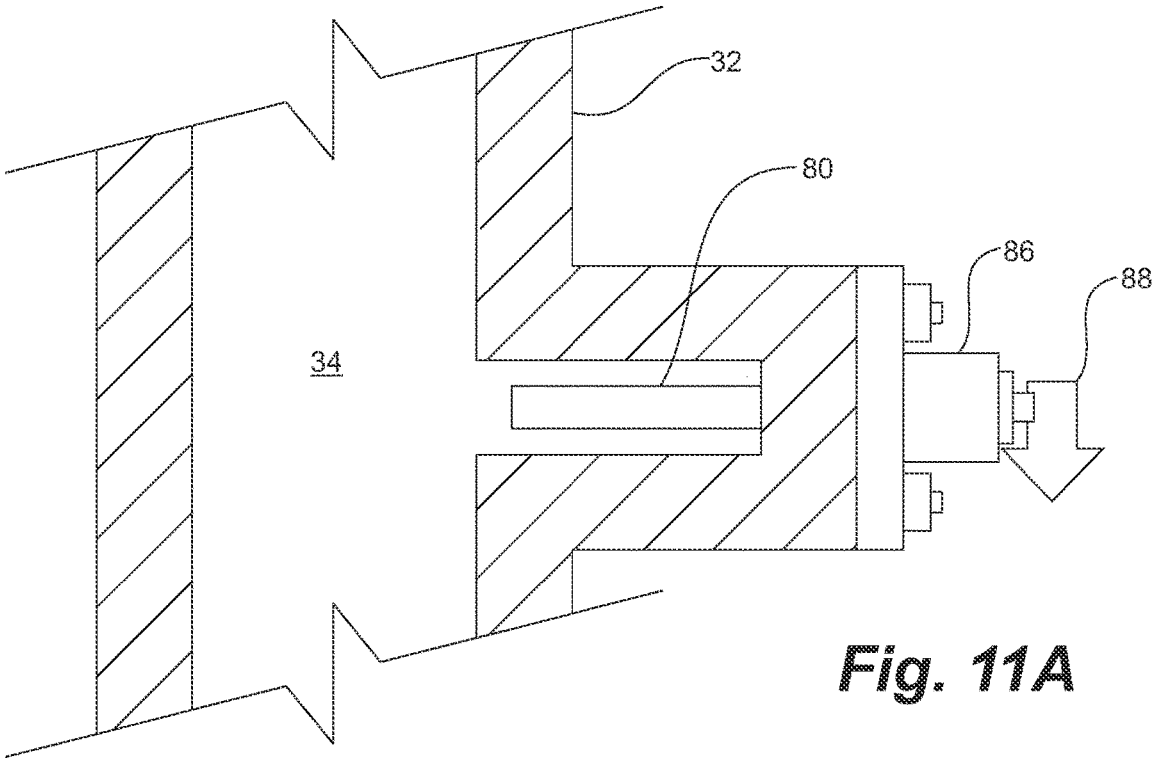
FIGS. 11A and 11B are partial side cross-sectional views of an injector head having a staging mechanism comprising a gate with an aperture, the staging mechanism being in an open position in FIG. 12A and a closed staging position in FIG. 12B.
Figure 11B:
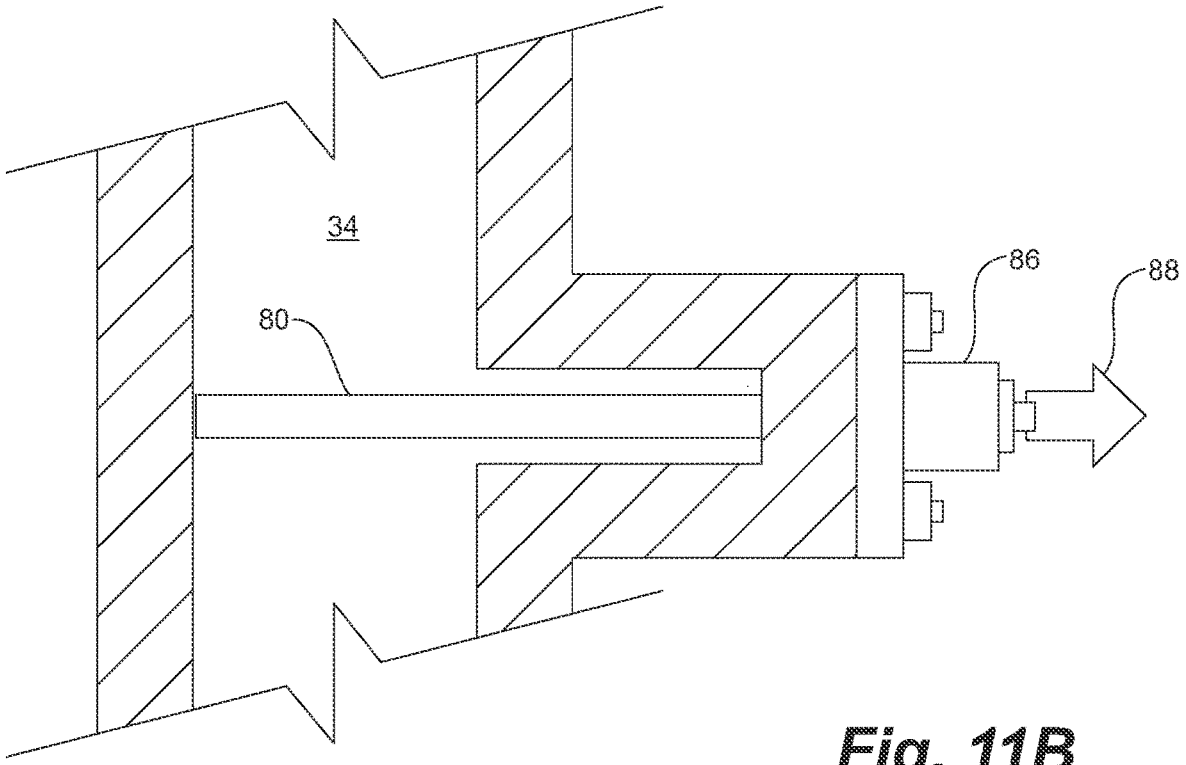

In an alternative embodiment, with reference to FIGS. 11A and 11B, the staging mechanism 80 can be a gate 82 having an aperture 84 sized to permit a sleeve 12 to pass therethrough towards the wellbore 14. In the closed staging position, the gate 82 can be positioned to substantially obstruct the injector bore 34 to prevent the passage of a sleeve 12 thereby. In the open position, the gate 82 can be positioned such that the aperture 84 is substantially radially aligned and centered with the injector bore 34 for permitting a sleeve 12 to fall through the aperture 84 towards the wellbore 14. In embodiments, the aperture 84 can be tapered from an uphole end of the aperture 84 towards a downhole end. For example, the inner diameter at the uphole end of the aperture 84 can be about equal to the inner diameter of the injector bore 34, and the inner diameter of the downhole end of the aperture 84 can be about equal to the outer diameter of a sleeve 12 to be injected into the wellbore 14. The downhole end of the aperture 84 can further comprise a straight portion to better axially align the sleeve 12 passing therethrough with the injector bore 34. Such a tapered aperture 84 assists in axially aligning, and radially centering, a sleeve 12 with the axial bore 10, thus reducing the likelihood that the sleeve 12 will become stuck on debris or obstructions in the axial bore 10 as it falls toward the wellbore 14.

The staging mechanism 80 can further comprise an actuator 86, such as a lever, electric motor, or hydraulic actuator, configured to actuate the staging mechanism 80 between the open and closed positions. Similar to the magazine actuators 58, the staging mechanism 80 can be actuated manually or remotely, and can be actuated mechanically, electrically, or hydraulically.

The staging mechanism 80 can have an indicator 88 located outside the injector head 32 or otherwise visible to an operator and configured to indicate whether the staging mechanism is in the open or staging position. For example, the indicator 88 could be an arrow located at a distal end of the staging mechanism 80 that points radially outwardly away from the injector bore 34 in a closed position when the staging mechanism 80 is in the staging position, and pointing in a direction generally perpendicular to the direction of the closed position when the staging mechanism 80 is in the open position. Alternatively, the indicator 88 can be a light that is illuminated when the staging mechanism 80 is in the staging position, or illuminates red when the staging mechanism 80 is in the staging position and green when the mechanism 80 is in the open position.

Certain sleeves 12 may be too long to stage on the staging mechanism 80, as being staged thereon may obstruct the path of a retaining device 90, described in further detail below, or other components thereabove. To address this, in embodiments, multiple staging mechanisms 80 can be located at various axial positions along the injector bore 34, such that the injector 30 is capable of staging sleeves 12 of different lengths without the sleeves 12 obstructing the path of the retaining device 90.

In embodiments, the staging pin or gate 82 can have a resilient material applied to, or embedded in, its surface to reduce the impact force imparted thereto by a falling sleeve 12. For example, the resilient material can be PTFE.

The staging mechanism 80 can be coated for sleeve impact absorption and tapered for clean retraction during closing steps.

Retaining Device

The injector 30 can further comprise a sleeve retaining device 90 for managing the indexing of sleeves 12 into the injector bore 34 and prevent subsequent sleeves from being introduced into the injector bore 34 before the selected sleeve has been injected into the wellbore 14 or has otherwise cleared the injector bore.

With reference to FIGS. 12A-13B, the retaining device 90 can comprise a retaining arm 92 extending into the injector bore 84 opposite a corresponding magazine 50. The retaining arm 92 can be operatively coupled to a retaining actuator 94 configured to actuate the retaining arm 92 between a closed retaining position, and a retracted open position. In the retaining position, the arm 92 extends across the injector bore 34 towards the magazine 50 to obstruct the open end 54 of the corresponding magazine 50 and prevent the sleeves 12 therein from being introduced into the injector bore 34. In the retracted position, the arm 92 is retracted to permit sleeves 12 to be launched from the magazine 50 into the injector bore 34. The actuator 94 of the retaining device 90 can be operated manually or remotely, and can be mechanically, electrically, or hydraulically actuated.

In embodiments having multiple magazines 50, the injector head 32 can comprise multiple retaining devices 90, each retaining device positioned opposite a corresponding magazine 50 to selectably permit sleeves 12 to be indexed therefrom into the injector bore 34. For example, two magazines 50 can be installed on the injector head 32, with two retaining devices 90 installed opposite thereto. Each set of opposed magazine 50 and retaining device 90 can be angularly offset by 90°.

For embodiments of an injector 30 having a rotating collar 38 located in the injector bore 34, the rotating collar 38 can have a slot 39 for receiving sleeves 12 from a selected magazine 50, and also a second slot 39' opposite the slot 39 for permitting the retaining device 90 to actuate therethrough to selectably block the open end 54 of the magazine.

In embodiments, a head portion 96 can be located on a sleeve-engaging end of the arm 92. The head portion 96 can be configured to engage with a selected sleeve 12 to be introduced into the injector bore 34 and axially align the sleeve 12 therewith, such that the selected sleeve 12 is substantially parallel to the injector bore 34, to reduce the likelihood of the sleeve 12 becoming stuck as it falls towards the staging bore 42. In embodiments, the head portion 96 has a concave engaging face 98 having a curvature that generally corresponds with the outer diameter of the sleeve 12 to be introduced into the injector bore 34. For example, if the selected sleeve 12 to be introduced into the injector bore 34 has an outer diameter of 3.781", the radius of curvature of the engaging face 98 can be about 3.8" or 3.85" to keep the sleeve 12 axially aligned with the injector bore 34.

In embodiments, the head portion 96 of the retaining device 90 can be interchangeable, such that head portions 96 with faces 98 having different radii of curvature can be selected according to the size of sleeve 12 to be injected into the wellbore 14. In other embodiments, the head portion 96 can be adjustable such that its engaging face 98 has a selectively variable radius of curvature in order to accommodate different sizes of sleeves 12.

In some embodiments, the actuator 94 can be configured to only retract enough to allow a single selected sleeve 12 to be introduced into the injector bore 34 at a time, thus reducing the likelihood of a subsequent sleeve being introduced into the injector bore 34 while the selected sleeve 12 is still located therein.

Figure 12A:
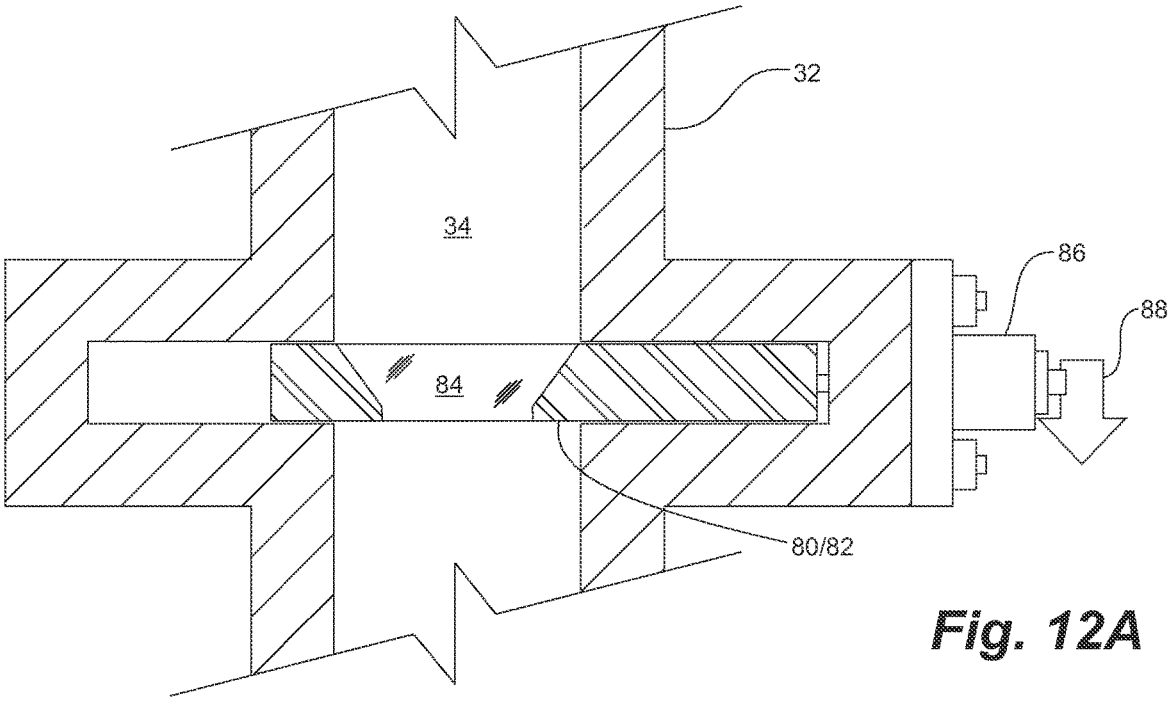
FIGS. 12A and 12B are view of a retaining device with adjustable stroke for restraining and indexing carrier sleeves of differing diameters.
Figure 12B:
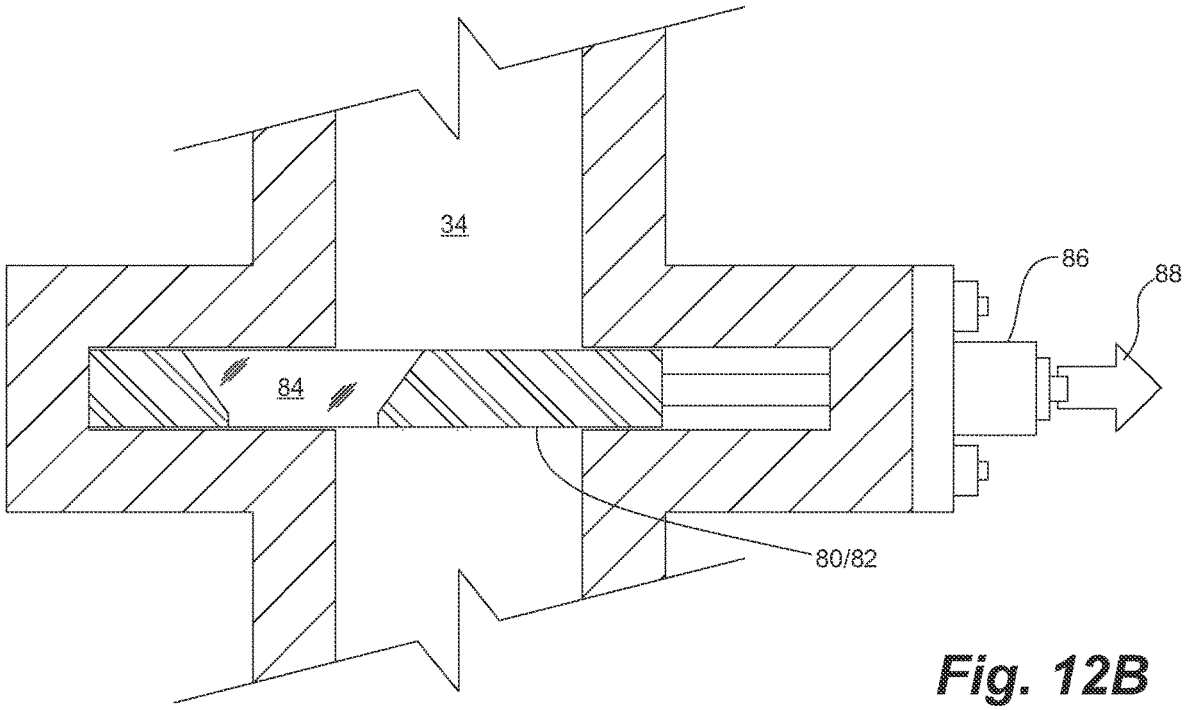
Figure 13A:
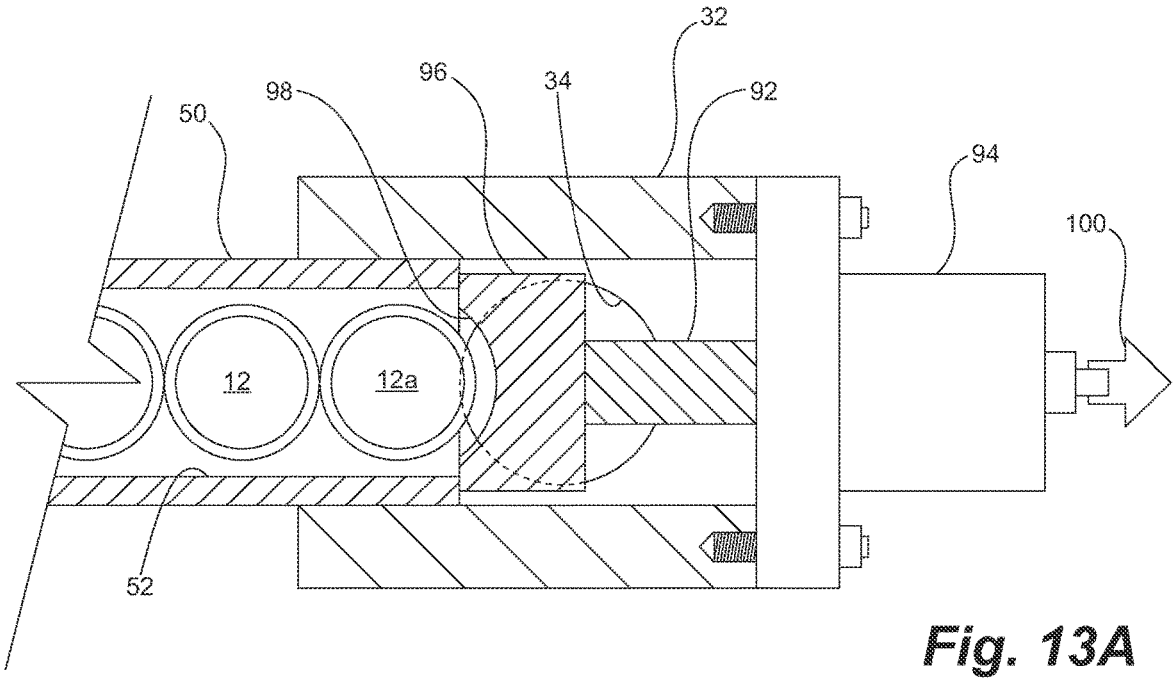
FIGS. 13A and 13B are partial top cross-sectional views on an injector head having a retaining device, the retaining device being in a closed retaining position in FIG. 13A and an open retracted position in FIG. 13B.
Figure 13B:
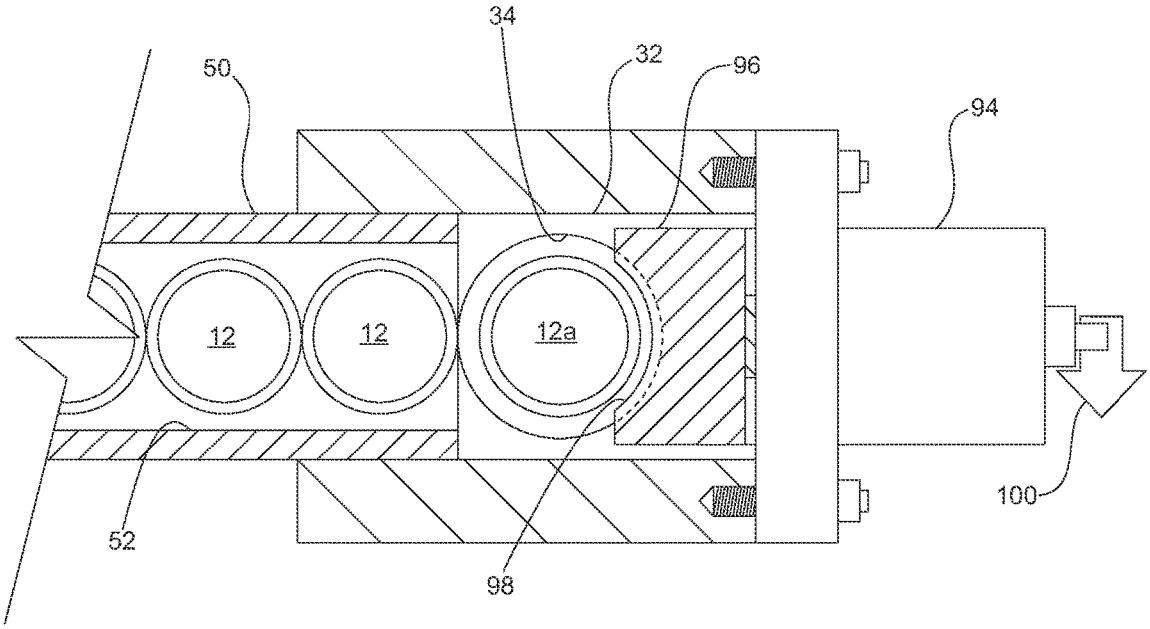

In embodiments, as best shown in FIGS. 12A and 12B, the retaining actuator 94 can adjust the stroke distance between the retaining position and the open retracted position to accommodate different weights and sizes of sleeves 12. For example, in FIG. 12A the actuator 94 of the retaining device 90 travels a given stroke distance D to index a sleeve 12 into the injector bore. In FIG. 12B, to index a sleeve 12 having a smaller outer diameter, the actuator 94 travels a shorter stroke distance D' to index the sleeve. In embodiments, the actuator 94 can have various indexed stroke distances to accommodate sleeves 12 of different weights and outer diameters.

Similar to the staging mechanism 80, the retaining device 90 can also have an indicator 100, for example located on the actuator 94, to provide the operator with information as to whether the retaining device 90 is in the open or closed position.

In embodiments, the magazine actuator 58 and corresponding retaining actuator 94 can be actuated in unison while introducing a selected sleeve 12 into the injection bore 34 to assist in keeping the sleeve axially aligned with the injector bore 34 as it is introduced therein. For example, the magazine actuator 58 can progress to a subsequent indexed position to index the selected sleeve 12 into the injector bore 34, and the restraining actuator 94 can retract the restraining device 90 to an intermediate position, travelling the same distance as the magazine actuator 58. Once the selected sleeve 12 has been introduced into the injector bore 34, the selected sleeve 12 may fall under its own weight towards the staging bore 42. In some instances, the sleeve 12 may be frictionally held in the injector bore 34 between the retaining mechanism 90 and a subsequent sleeve in the magazine 50 or the actuator plate 62 and prevented from falling. In such a case, the retaining actuator 94 can further retract the retaining device 90 from the intermediate position to the open retracted position to permit the sleeve 12 to fall towards the staging bore 42.

The successive steps of axially aligning and centering sleeves 12 performed by the retaining device 90 and staging mechanism 80 reduce the likelihood of a jam occurring in the injector 30 due to a sleeve catching on debris or another structure within the axial bore 10.

Verification Device

The wellhead 16 can include one or more verification devices for confirming that the selected sleeve 12 was successfully introduced into the injector bore 34, staged in the staging bore 42, and/or injected into the wellbore 14. For example, with reference to FIG. 9, a camera 102 could be located in the injector bore 34 at an axial location uphole of the magazines 50 and oriented downhole to acquire still image and/or video data regarding the status of the selected sleeve 12 and the various components of the wellhead 16.

In embodiments, with reference to FIGS. 8A and 8B, one or more a trip levers 104 can be located at select points along the axial bore 10. For example, a trip lever 14 may be positioned adjacent to, and above, the staging mechanism 80. The trip lever 104 is rotatably mounted on the injector head 32 or wellhead 16 about an axis 106 such that the lever 104 is rotatable along a plane substantially parallel to the axial bore 10. A bore end 108 of the trip lever 104 extends radially into the axial bore 10 and an indicator end 110 extends out of the wellhead 16 such that it is visible from the exterior of the wellhead 16. The trip lever 104 is actuable between a resting position and a triggered position. When the lever 104 is in the resting position, the bore end 108 and indicator end 110 are respectively in a first bore end and indicator end position. When the lever 104 is in the triggered position, the bore end 108 is in a second bore end position downhole of the first bore end position, and the indicator end 110 is in a second indicator end position uphole of the first indicator end position. In embodiments, the trip lever 104 is biased to the resting position, for example by making the indicator end 110 longer than the bore end 108 such that the lever 104 is gravitationally biased to the resting position.

When a sleeve 12 approaches the axial position of a trip lever 104, the sleeve 12 forces the bore end 108 downhole such that the lever 104 rotates to the triggered position. After the sleeve 12 clears the trip lever 104, the lever 104 can rotate back to the resting position to indicate that the sleeve 12 has cleared that section of the axial bore 10.

As one of skill would understand, the bore end 108 of the trip lever 104 should be long enough to contact a sleeve 12 as it travels past the lever 104, but short enough so as to not obstruct or impede the downhole progress of the sleeve 12. Likewise, the triggering force required to actuate the lever 104 to the triggered position can be selected so as to not interfere with the progress of the sleeve 12. For example, the lever 104 could be configured to require a force of 1 lb-2 lbs to actuate to the triggered position. As sleeves 12 are typically about 15-25 lbs, such a triggering force would not significantly interfere with the sleeve 12 as it falls toward the wellbore 14. In embodiments, the bore end 108 of the lever 104 can be made of a flexible, resilient material to reduce the likelihood that a sleeve 12 becomes stuck on the trip lever.

Figure 9:
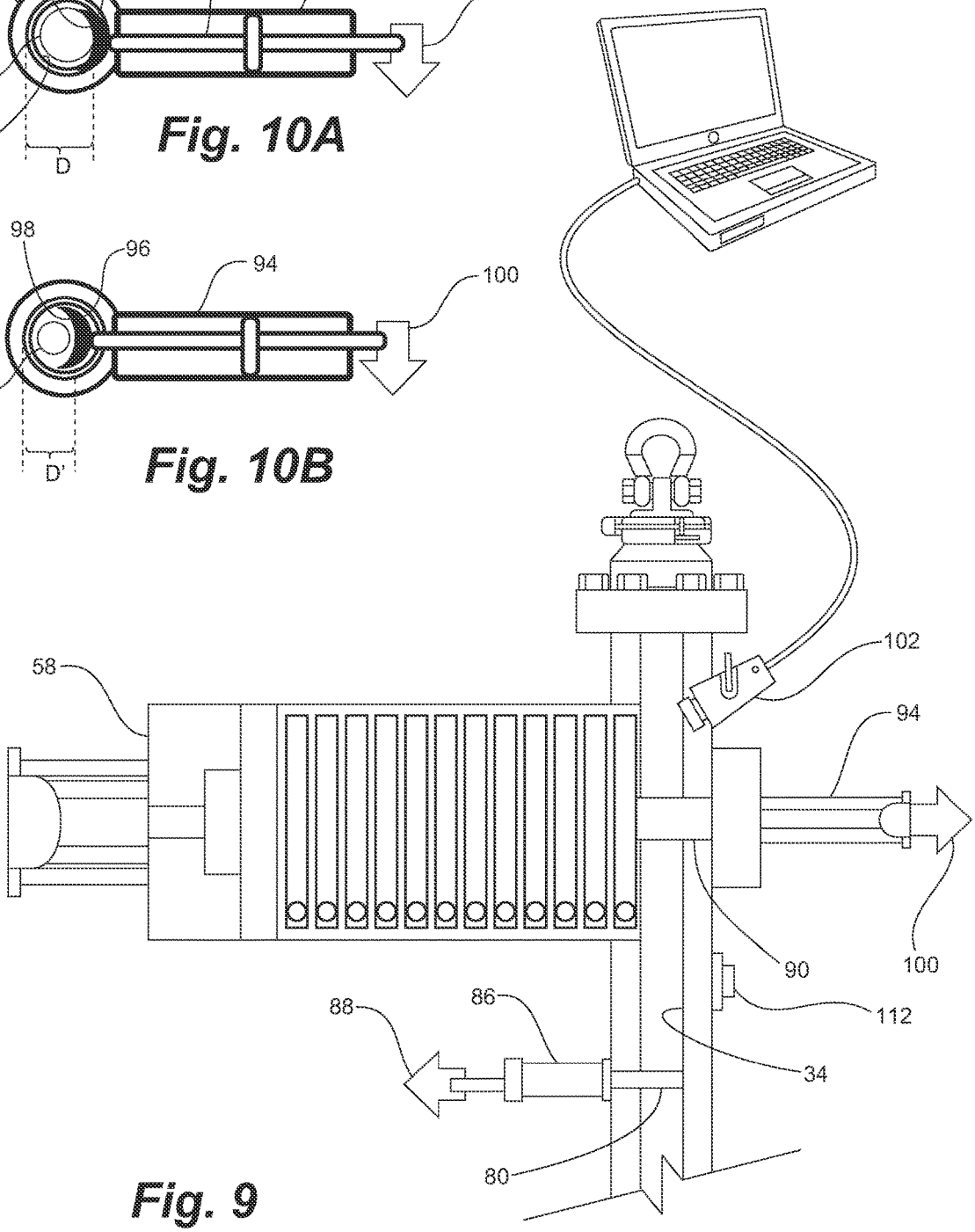
FIG. 9 is a cross-sectional view of an injector head, the injector bore being fit with a camera for observing the injector bore and launch area to verify the successful indexing of a sleeve, and to identify problems.

In other embodiments, with reference to FIG. 9, an acoustic detection device/sensor 112 can be used on upper wellhead structure 16 or lower isolation valve 46 as shown for receiving signals emanating from downhole, the signal indicative of the actuation of the target device, such as the opening of a sliding sleeve. Further, the detection device 112 can receive an acoustic signal when the selected sleeve 12*a* strikes the staging mechanism 80 or isolation gates 44, 46 as an indicator to communicate to an operator that the sleeve 12*a* had been successfully introduced into the axial bore 10. Moreover, in embodiments, the acoustic detection device 112 may be configured to confirm receipt of a sleeve 12 downhole in the wellbore 14 at the corresponding sleeve-actuated device, for example by detecting the acoustic signal generated by such engagement downhole communicated via the wellbore casing, fluids, or another suitable medium.

In Operation

TABLE 1

Sleeve Injection Process

| Block | STEP | Retaining device 90 | Staging mechanism 80 | Upper Valve 44 | Lower Valve 46 | Pressure Staging bore 42 |
|---|---|---|---|---|---|---|
| 200 | Confirm staging mechanism and retaining device closed | C | C | X | X | P ~ 0 = P1 |
| 202 | Load sleeve - drop to staging mechanism | O | C | X | X | P ~ P1 |
| 204 | Close retaining device | C | C | X | X | P = P1 |
| 206 | Pressure test staging bore to PT | C | C | X | X | P = PT > P2 |
| 208 | Bleed Staging Bore | C | C | X | X | P ~ P1 |
| 210 | Remove liquid from staging bore | C | C | X | X | P = P1 |
| 212 | Open Upper Valve | C | C | O | X | P = P1 |
| 214 | Check for sleeve jam above staging mechanism | C-O-C | C | O | X | P = P1 |
| 216 | Open staging mechanism | C | O | O | X | P = P1 |
| 218 | Sleeve drop to Lower Valve | C | O | O | X | P = P1 |
| 220 | Close staging mechanism | C | C | O | X | P = P1 |
| 222 | Close upper valve | C | C | X | X | P = P1 |
| 224 | Pump up staging bore to at or above about P2 | C | C | X | X | P ≥ P2 |
| 226 | Open lower valve | C | C | X | O | P = P2 |
| 228 | Sleeve released to wellbore | C | C | X | O | P = P2 |
| 230 | Close lower valve | C | C | X | X | P = P2 |
| 232 | Bleed staging bore Advance to block 208 for repeat with next sleeve | C | C | X | X | P ~ P1 |

Figure 1B:
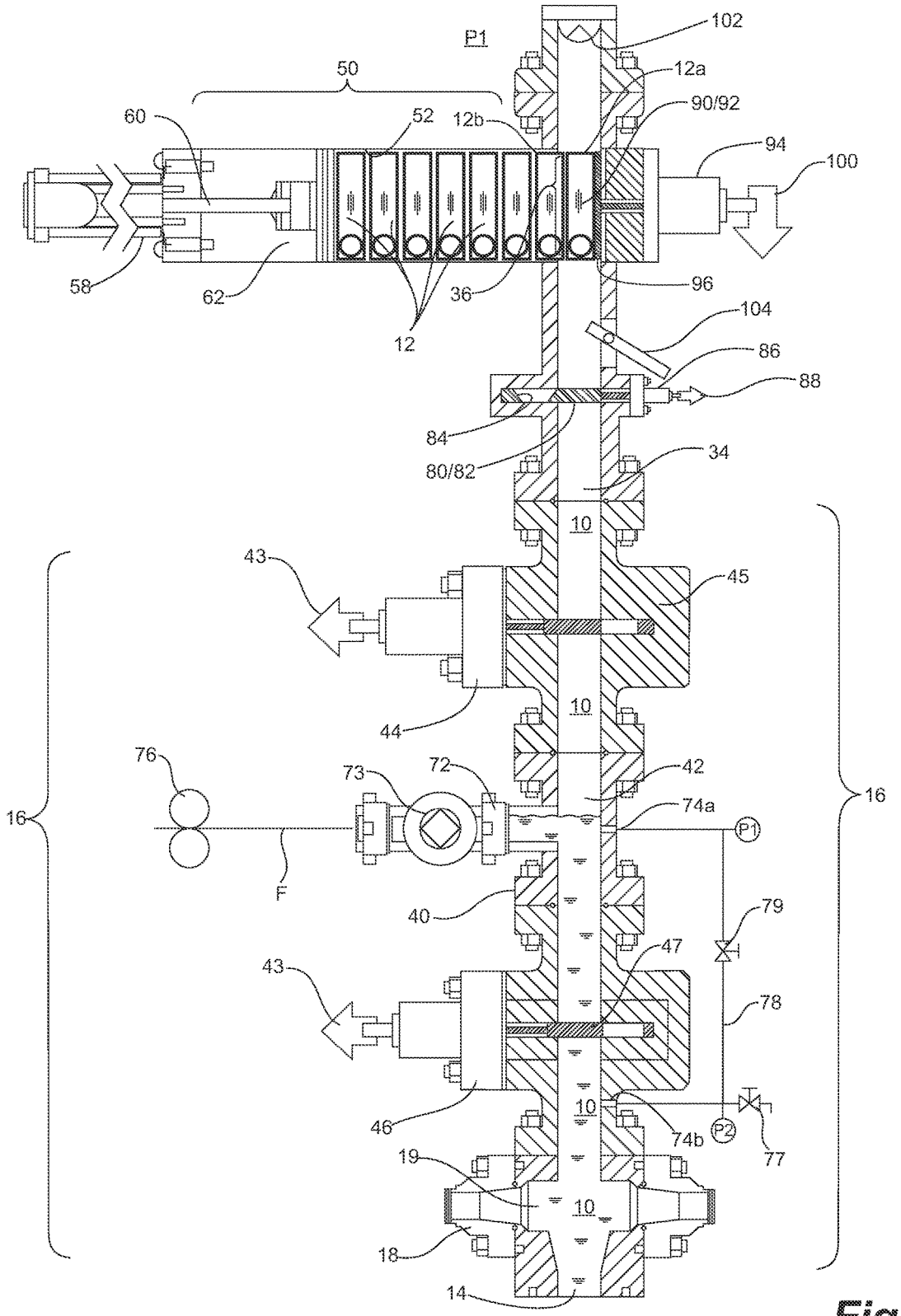
Figure 1C:
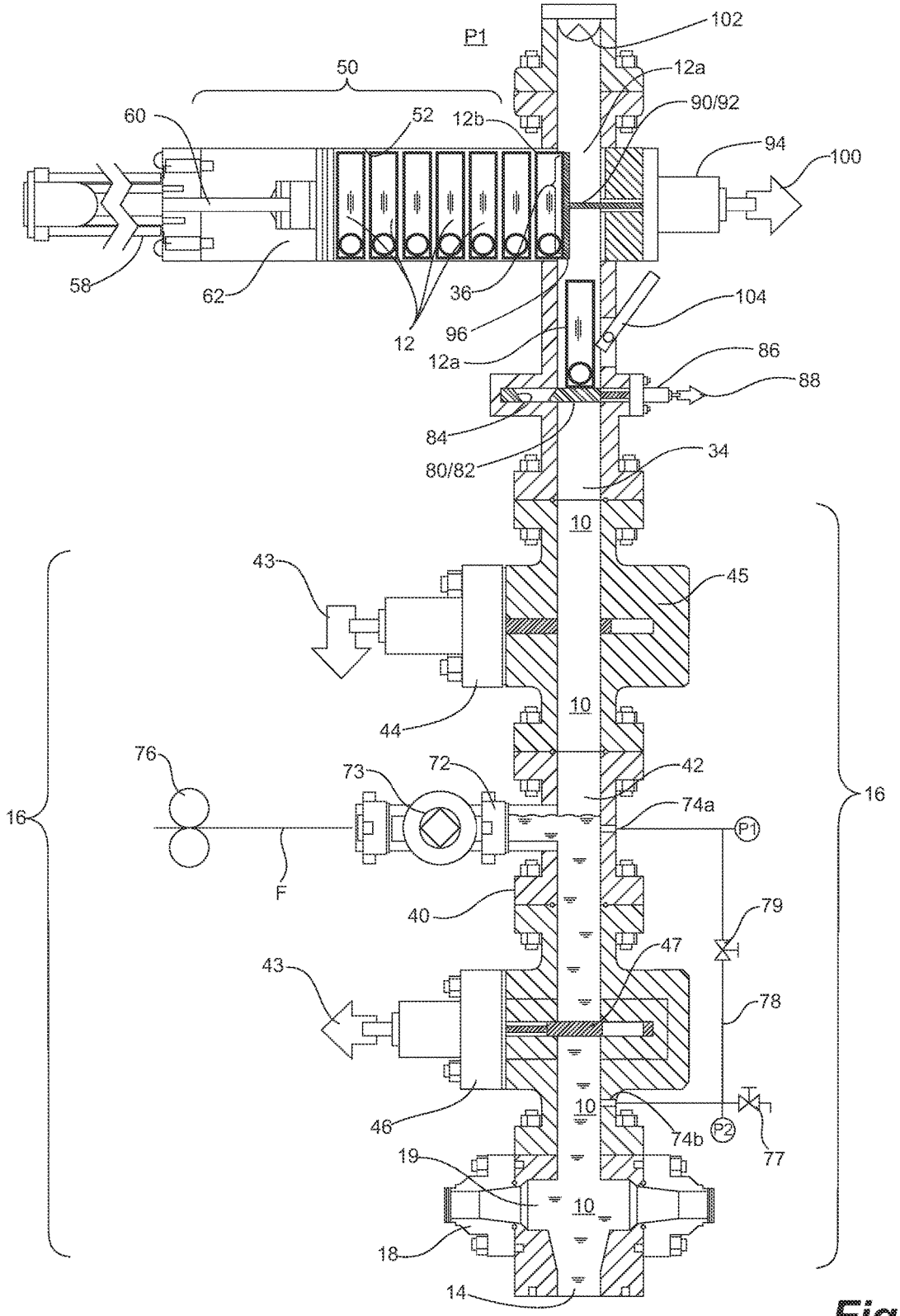
Figure 1D:
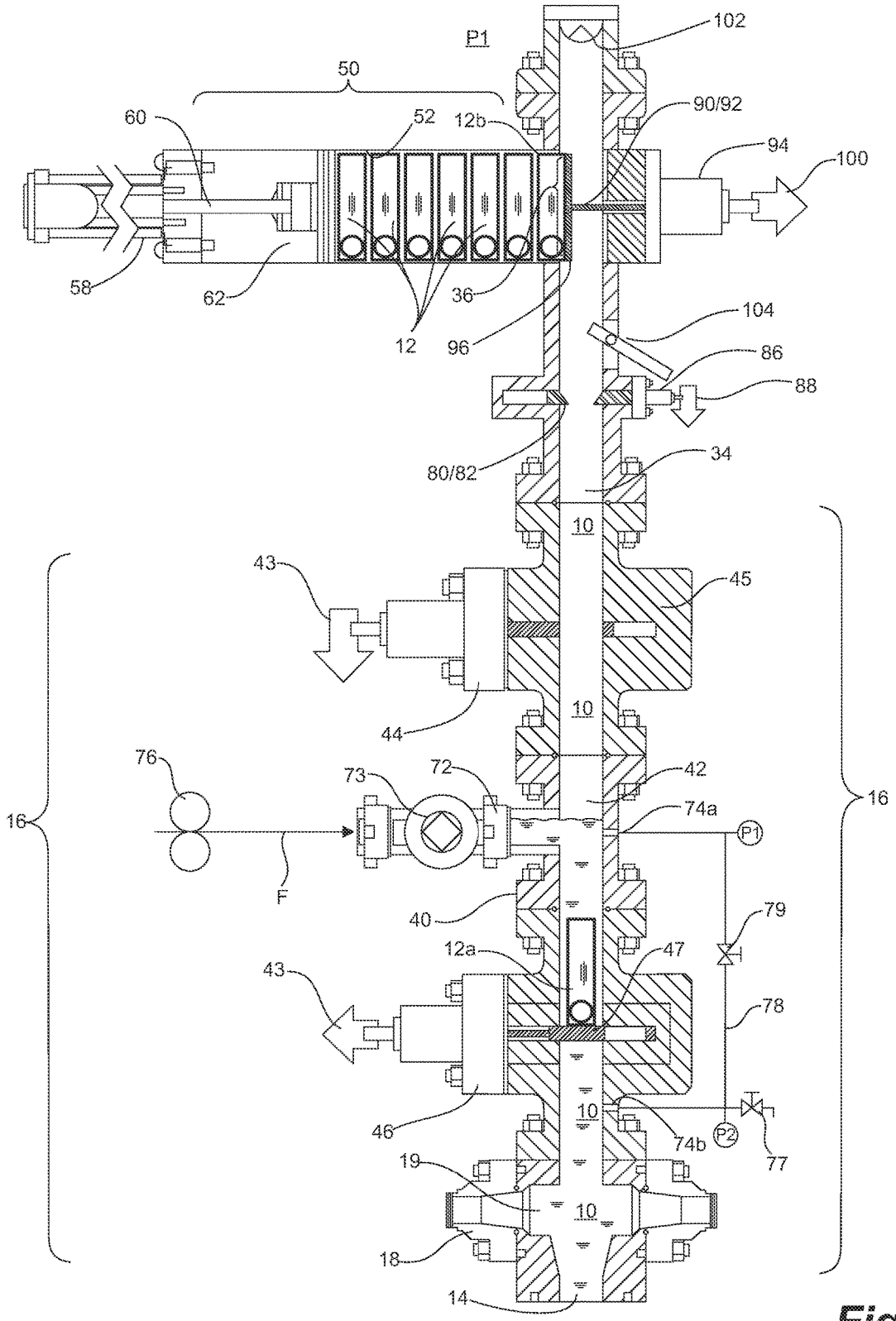
Figure 1E:
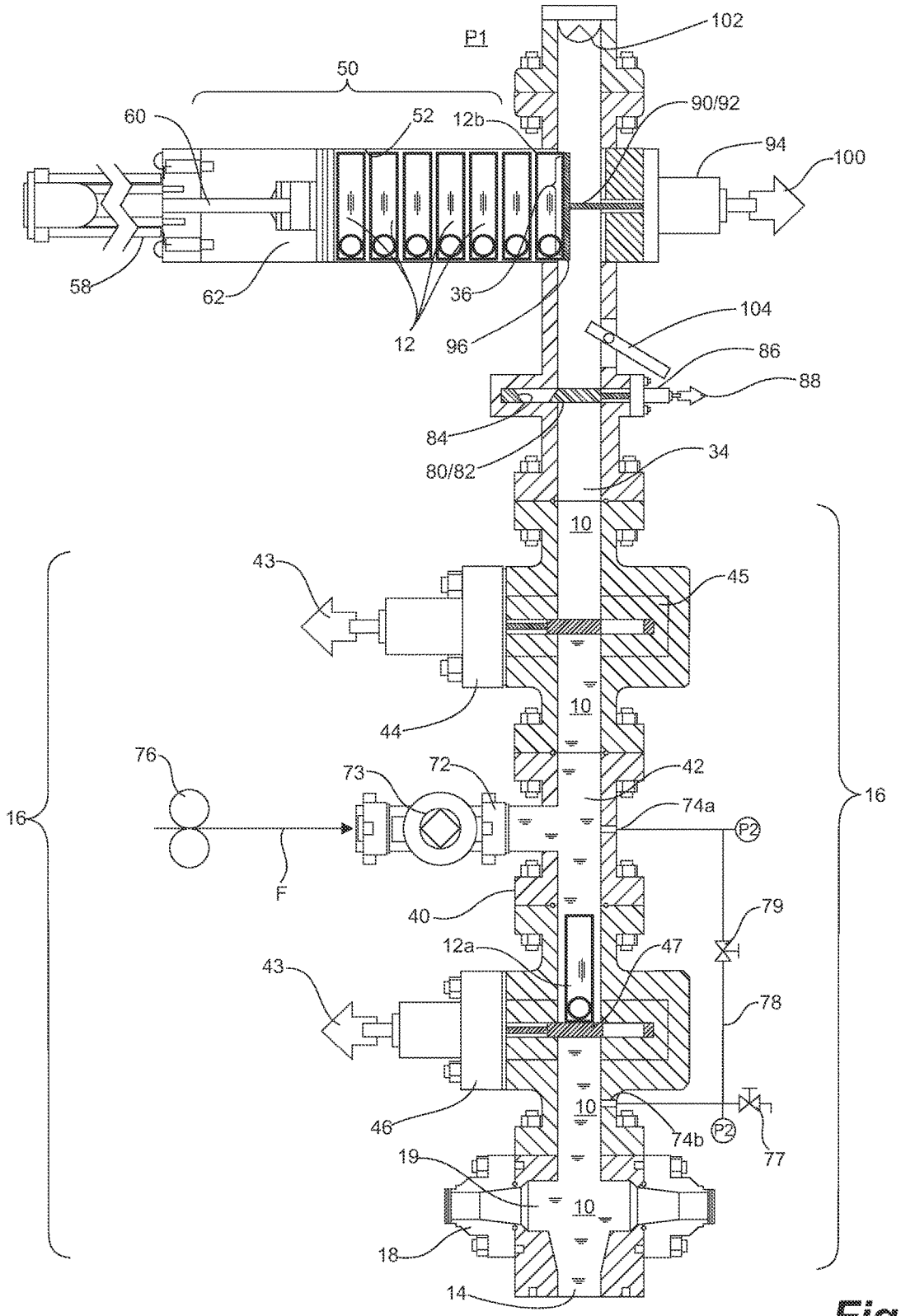
Figure 1F:
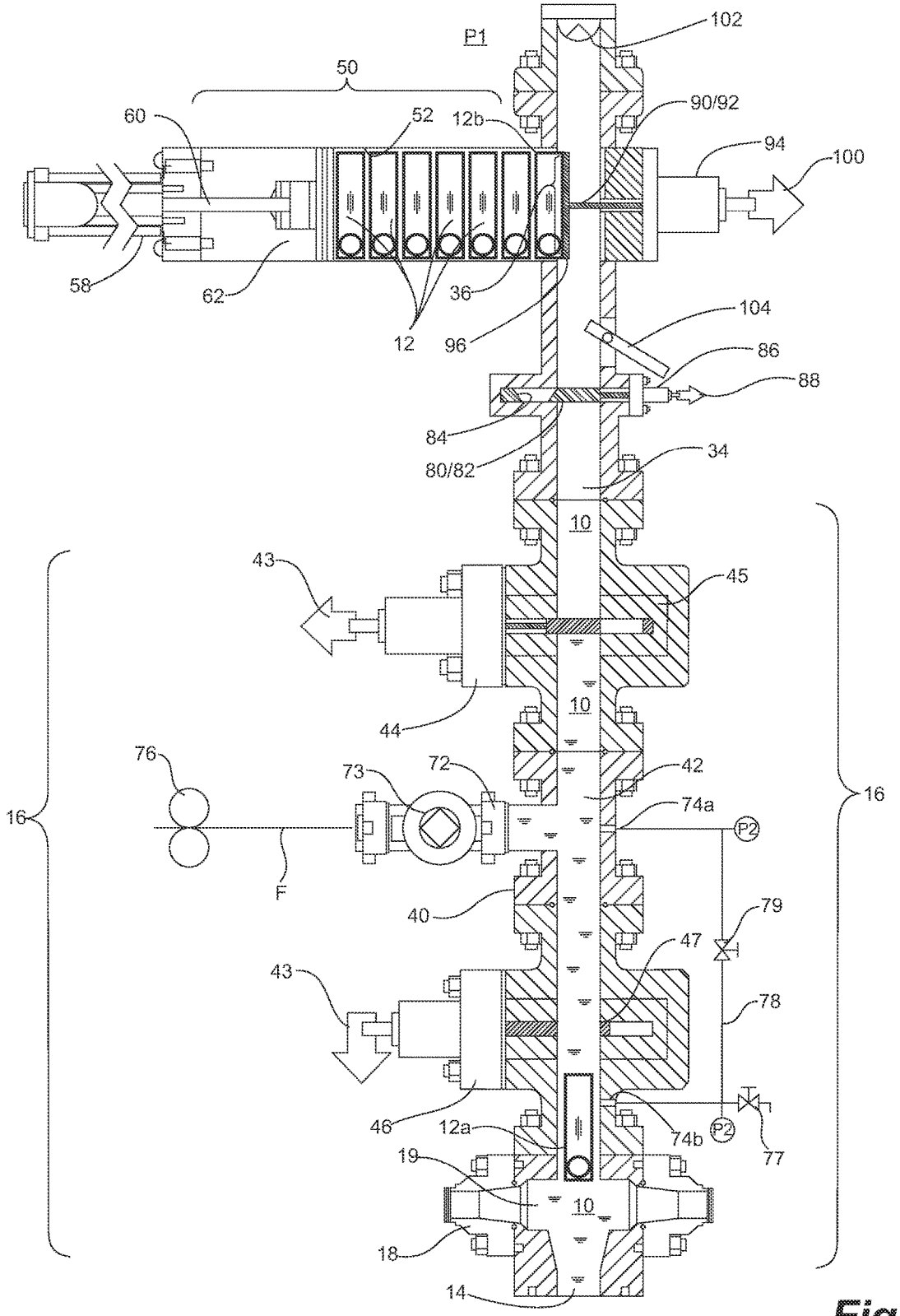
Figure 1G:
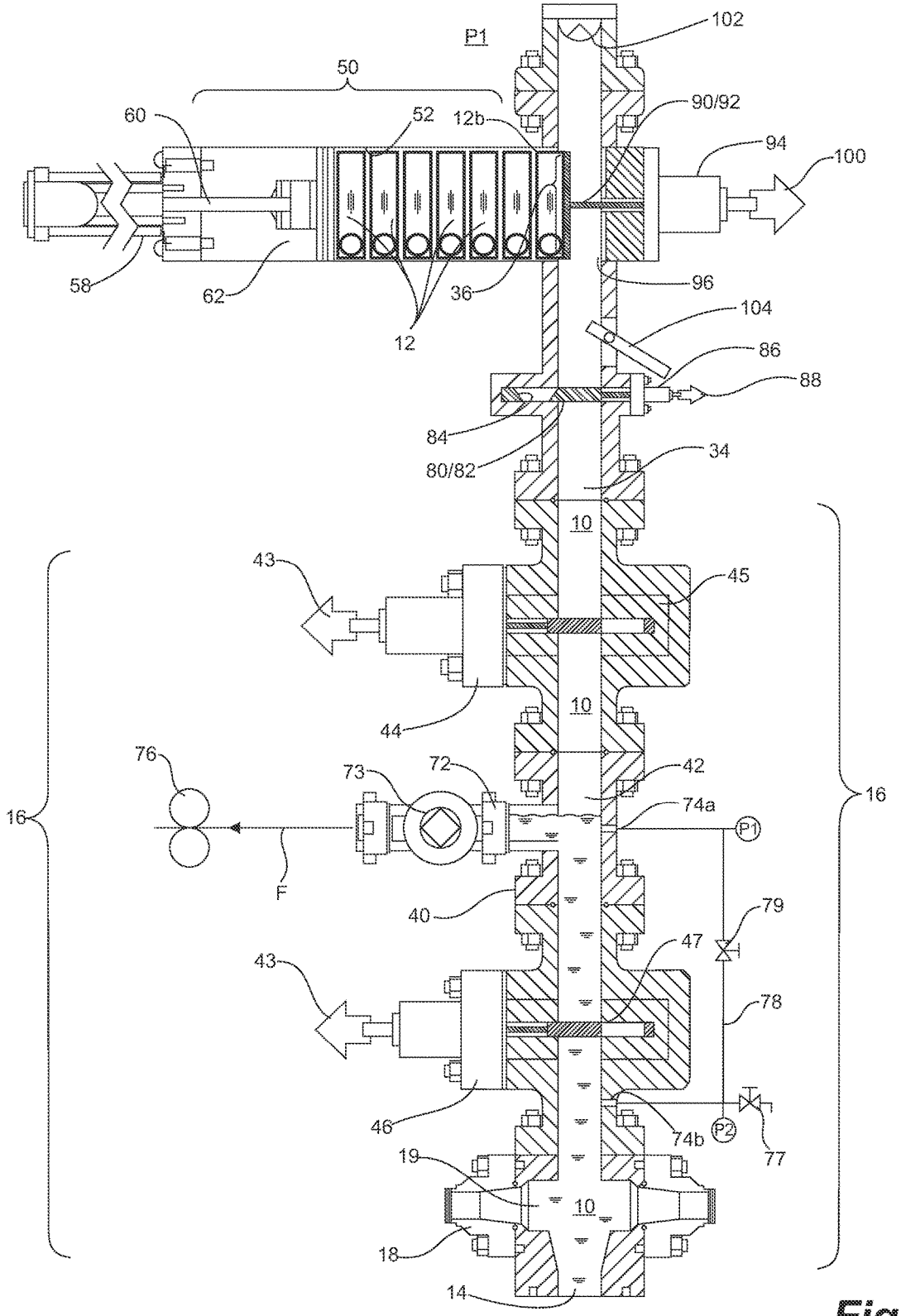
FIG. 1G illustrates the upper and lower isolation valves in the closed position and the pressure in the staging bore bled down to about atmospheric pressure.
Figures 1A, 1B, 1C, 2A:
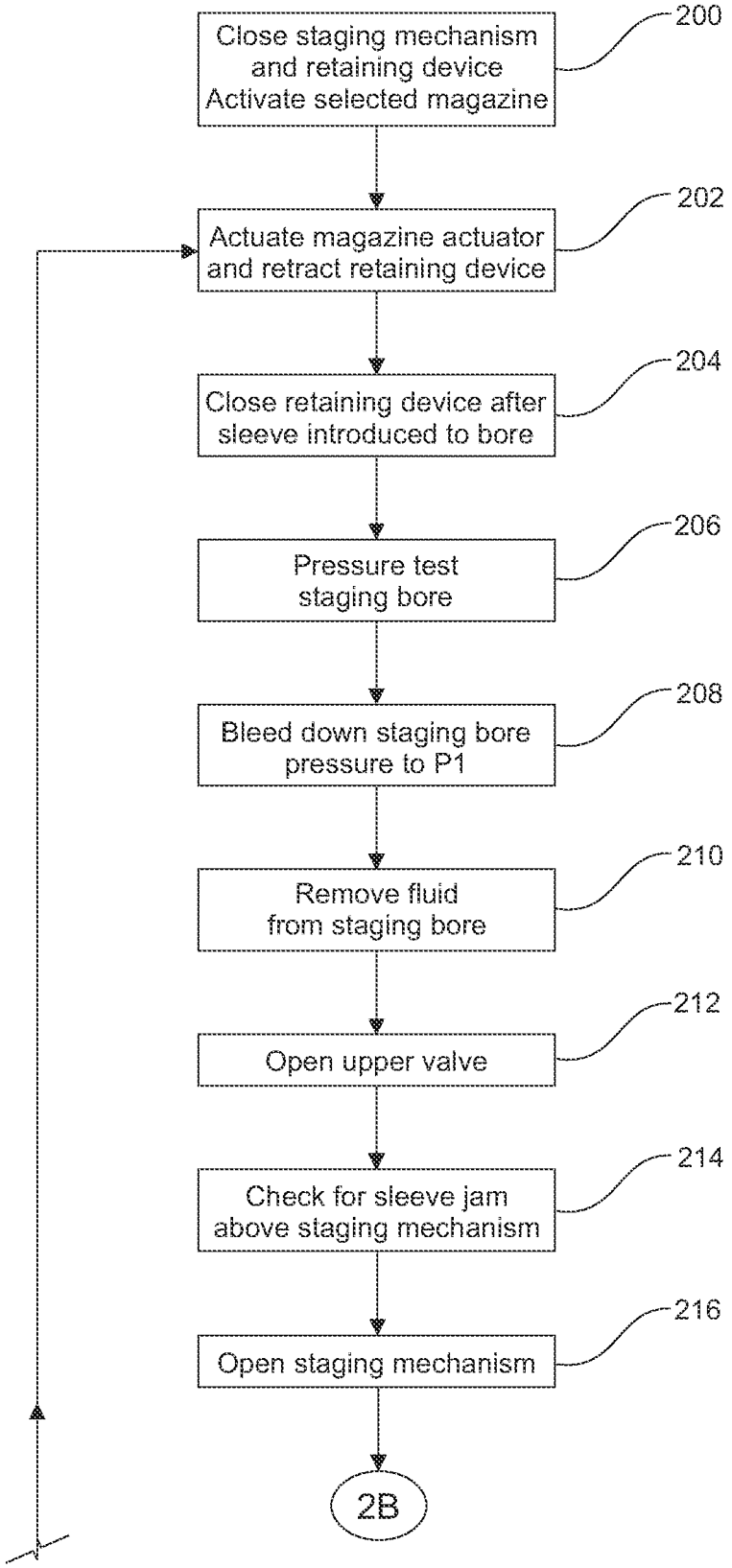
FIGS. 2A and 2B illustrate a flow chart depicting the various stages of sleeve injection shown in FIGS. 1A-1F.
Figure 2B:
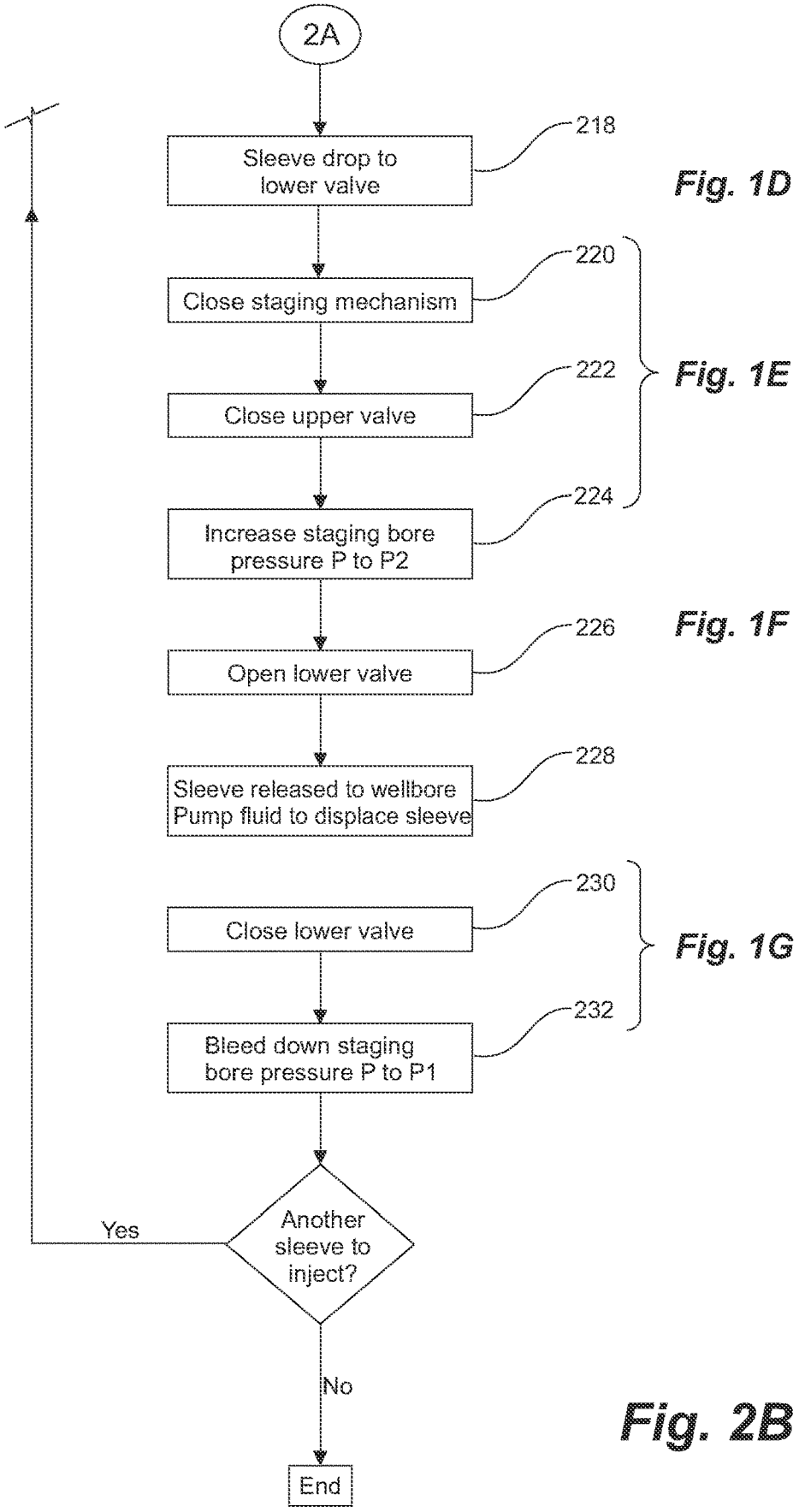

An exemplary sleeve injection procedure is illustrated in FIG. 2 and Table 1, above. FIGS. 1A to 1F depict an injection system as part of a wellhead 16 shown with carrier sleeves 12 at various steps of the injecting process, the injection system comprising an injector head 32, staging block 40, upper and lower isolation valves 44, 46, one or more magazines 50, a staging mechanism 80, and a retaining device 90. At the commencement of sleeve injection procedures into the wellbore 14, the staging mechanism 80, retaining device 90, and upper and lower isolation valves 44, 46 can be checked to ensure they are functional, that the magazines 50 are loaded with the appropriate carrier sleeves 12 for the operation, and that the magazines 50 and injector head 32 are fit with the appropriate indexing components for the size(s) of sleeve 12 to be injected. At block 200, with reference to FIG. 1A, the operator checks to ensure that the staging mechanism 80 is in the closed staging position, and the retaining device 90 is in the closed retaining position, and that the restraint 66 of the selected magazine 50 from which sleeves 12 are to be injected are removed/disengaged to render that magazine active. In embodiments using a rotating collar 38, the collar is rotated to align its slot 39 with the selected magazine 50 to render it active.

With reference also to FIG. 1B, at step 202, a first selected sleeve 12*a* is introduced into the injector bore 34 by actuating the magazine actuator 58 to index the selected sleeve 12*a* into the injector bore 34, and actuating the retaining device 90 to the retracted position. The other sleeves 12 in the magazine 50 remain in the magazine chamber 54. In some embodiments, as described above, the retaining device 90 can be actuated to an intermediate position as the magazine actuator 58 is actuated to index the selected sleeve 12*a* into the injector bore 34. In this manner, the sleeve 12 is sandwiched between the magazine actuator 58/other sleeves 12 of the magazine 50 and the engaging face 98 of the retaining device 90 as it is introduced into the injector bore 34, thus maintaining the sleeve 12*a* in axial alignment with the bore 34. Once the magazine actuator 58 stops to prevent further sleeves from being introduced into the injector bore 34, the retaining device 90 can actuate to the fully open retracted position to release the sleeve 12*a* and allow it to drop onto the closed staging mechanism 80. The operator can confirm that the first selected sleeve 12*a* was successfully introduced into the injector bore 34 by verifying that the magazine indicator has moved to the next sleeve position, looking into the sleeve window 56 to confirm the sleeves 12 have advanced, and/or checking the verification device, such as a camera 102 or trip lever 104. Once delivery of the selected sleeve 12*a* into the injector bore 34 is confirmed, the magazine actuator 58 can be deactivated or released.

At step 204, after the sleeve 12*a* has been released and dropped onto the staging mechanism 80, the retaining device 90 can be actuated back to the closed retaining position to prevent the other sleeves 12 in the magazine 50 from entering the injector bore 34. The indicator on the retaining device 90 will then indicate that the retaining device 90 is in the fully closed position.

At step 206, a pressure test can be performed on the staging block 40 by closing upper and lower isolation valves 44, 46 and using pump 76 to increase the pressure P inside the staging bore 42 to test pressure PT, for example to at or above wellbore/fracturing pressure P2. Thereafter, at step 208, the pressure in the staging bore 42 can be bled down via the fluid port 72 back to the pressure pump 76 back down to about atmospheric pressure P1, and fluid can be removed from the staging bore 42 using pump 76 down to the level of the fluid port/pump inlet 72 (step 210). Liquid remains at or below the fluid port 72 and on top of the lower isolation valve 46.

With reference to FIG. 1C, and at step 202, the first selected sleeve 12*a* has dropped onto the closed staging mechanism 72. At step 212, with the pressure in the staging bore 42 at P1, the upper isolation valve 44 is opened as shown in FIG. 1C while the lower isolation valve 46 remains closed, thus isolating the staging bore 42 from wellbore pressure P2. The selected sleeve 12*a* is prevented from free falling into the axial bore by closed staging mechanism 80. Not shown, as an intermediate step, to minimize sleeve drop energy, the upper isolation valve 44 can remain closed until the sleeve 12*a* is resting thereon. For FIG. 2, in this described operation, it is assumed that upper isolation valve 44, immediately below the injector head 32, is opened before the selected sleeve 12*a* can drop thereon.

The actuators 58 of the magazines 50 remain inactive. If not already closed, the retaining device 90 is actuated to the closed position for restraining the remaining sleeves 12 loaded in magazine 50.

At step 214, if the first selected sleeve 12*a* has not fallen clear of the retaining device 90, nor dropped to the staging mechanism 80, for example in the event of a jam, the retaining device's indicator will not indicate that the retaining device 90 is in the fully closed position. In embodiments wherein a hydraulic actuator 94 is used for the retaining device 90, the hydraulic pressure will increase in the actuator 94. In embodiments wherein a mechanical or electric actuator 94 is used, mechanical or electrical load will increase, respectively. In such an event, the operator can cease injection operations and check the injector 30 for a jam. Of course, such jam checking and clearing procedures can be performed at any point after the first selected sleeve 12*a* has been introduced into the injector bore 34.

With reference also to FIG. 1D and step 216, the staging mechanism 80 is actuated to the open position such that it clears the injector bore 34, and at step 218 the first selected sleeve 12*a* is shown dropping past the opened staging mechanism 80 and first gate valve 44 into the liquid in the staging bore 42 above the closed lower isolation valve 46. Pump 76 can optionally fill the staging bore 42 with additional fluid F to provide energy dampening for absorbing some of the energy of the falling sleeve 12*a*. Equalization valve 79 remains closed and staging bore 42 is at about atmospheric pressure P1.

At step 220, as shown in FIG. 1E the staging mechanism 80 is actuated to the closed position such that it is ready to stage a subsequent selected sleeve 12*b*. The retaining device 90 is maintained in the closed position to prevent a subsequent selected sleeve 12*b* from being prematurely loaded into the injector bore 34.

With reference again to FIG. 1E, and at step 222, the upper isolation valve 44 is closed to isolate the staging bore 42 from the injector bore 34. At step 224, as shown in FIG. 1D, the pumper 76 pressures up the staging bore 42 to about the frac pumping pressure P2 or higher. Alternatively, or in additionally, equalization valve 79 can be opened to connect the staging bore 42 to the wellbore 14, pressurizing the staging bore 42 to at least wellbore pressure P2. If desired, the staging bore 42 can be pressurized to above wellbore pressure P2 by closing equalization valve 79 and operating pump 76 to introduce additional fluid F and pressure therein.

Turning to FIG. 1F, and at step 226, the lower isolation valve 46 is opened to allow selected sleeve 12*a* to fall into the wellbore 14. At step 228, the first selected sleeve 12*a* can fall by gravity or be assisted downhole by displacement fluid F from pump 76, and thereafter by fracturing fluid flowing into the wellbore 14 from the fracturing inlets of the frac head 18 therebelow. The displacement fluid F from pump 76 can also act to purge the axial bore 10 below fluid port 72 of sand and other debris. In cold weather conditions, methanol or other suitable fluids could also be introduced into axial bore 10 by pump 76 to avoid freezing of wellhead components.

With reference to FIG. 1G, once the first selected sleeve 12*a* has been injected into the wellbore 14, at step 230, the lower isolation valve 46 is closed and at step 232 the staging bore 42 is bled down by removing fluid F therefrom using the pumper 76 via port 72, or via bleed port 77, until the staging bore 42 is at about atmospheric pressure P1. When the staging bore 42 pressure is at about P1, it is safe to open the upper isolation valve 44 to permit communication between the injector bore 34 and staging bore 42 for the injection of a subsequent selected sleeve 12*b*.

To inject the subsequent selected sleeve 12*b*, and all other subsequent sleeves 12, the process can be repeated from step 202. One of skill in the art would understand that the pressure testing steps 206 to 210, and sleeve jam check step 214, need not be repeated for the injection of every sleeve 12.

Debris Clearing

Debris in the wellbore 14 can compromise the radial profile in the downhole device that a carrier sleeve 12 is intended to couple with. If the radial profile is sufficiently impeded, the carrier sleeve 12 can travel past the downhole device and therefore fail to isolate the desired stage.

In embodiments, prior to introducing a selected sleeve 12*a* into the axial bore 54, a gel slug other material suitable for swabbing the bore 12 can be introduced into the staging block 42 via port 80 and pumped downhole. The swab slug can purge sand and contaminants that may impede the sleeve 12*a* as it travels to the target device's radial profile for removing contaminants therefrom. For example, fracturing pumpers can pump a base gel through the frac head 18 and pump 76 can pump a burst of gel activator to create a viscous gel slug that travels down the wellbore 14.

Figure 14:
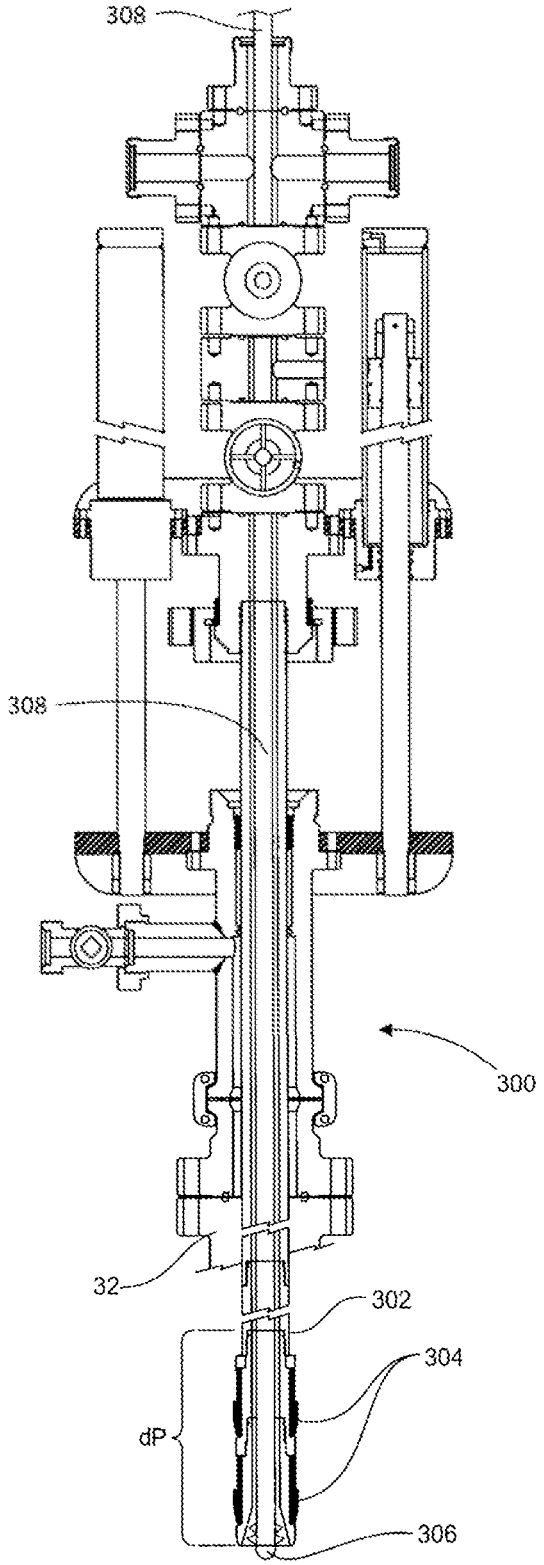
FIG. 14 is a side cross-sectional view of an upper isolation tool.

In alternative embodiments, the upper isolation device 44 is an upper isolation tool 300 of FIG. 14. The upper isolation device 44, used to separate the staging bore 42, from the injector bore 34, is now provided by an isolation tool 300. A tubular mandrel 302 is fit with seals 304 at a lower end thereof to form a movable seal along the axial bore 54. The seals 304 seal the annulus formed between the mandrel 302 and the axial bore 10. The seals 304 are suitable to restrain wellbore pressure P2 forming a dP thereacross. A guide rod 308 extends sealably through a bore of the isolation tool 300. The guide rod 308, mandrel 302, and seals 304 form a pressure plug in the axial bore 54.

The mandrel 302 seals against axial bore 54 to prevent wellbore pressure P2 and fluids from reaching the carrier sleeves 12 stored in injector 30. The lower isolation valve 46 remains located below staging block 40. The guide rod 308 and mandrel 302 can be independently actuated. Additionally, the guide rod 308 can also be fit with a swab cup 306, located at head 32 and sized swab the axial bore 54.

What is claimed is:

1. A sleeve injector for injecting carrier sleeves into an axial bore of a wellhead contiguous with a wellbore having sleeve-actuated devices therein, comprising:

an injector head adapted to be supported by the wellhead, the injector head having an injector bore therethrough in fluid communication with the axial bore;

at least one sleeve magazine having an aperture in communication with the injector bore, the at least one magazine storing at least two sleeves, each of the at least one sleeve magazine having an actuator operable for aligning a selected sleeve of the at least two sleeves with the injector bore; and a fall restrictor for holding the selected sleeve within the injector bore, and preventing premature alignment of a subsequent carrier sleeve, the fall restrictor comprising an actuator configured to bias the at least two sleeves stored in the at least one sleeve magazine into the injector bore to frictionally retain the selected sleeve within the injector bore.

2. The sleeve injector of claim 1 further comprising a guide rod, the rod extending moveably through the injector bore for forcibly launching the selected sleeve past the fall restrictor.

3. The sleeve injector of claim 2 wherein the guide rod extends into the injector bore for blocking the subsequent carrier sleeve from aligning with the injector bore.

4. The sleeve injector of claim 1 wherein the fall restrictor is an annular restrictor located in the injector bore downhole from a furthest downhole magazine of the at least one sleeve magazine for preventing free fall of the selected sleeve thereby.

5. The sleeve injector of claim 4 further comprising a guide rod, the rod extending moveably through the injector bore for forcibly launching the selected sleeve past the annular restrictor.

6. The sleeve injector of claim 1, wherein the at least one sleeve magazine is removeably connected to the injector head.

7. The sleeve injector of claim 1, wherein the at least one sleeve magazine has at least one indicator for indicating successful alignment of the selected sleeve with the injector bore.

8. A system for injecting carrier sleeves into a wellbore, comprising:

a sleeve injector having an injector bore and configured to store at least two carrier sleeves in at least one magazine and operable to align a selected sleeve of the at least two carrier sleeves with the injector bore;

a staging block having a staging bore in communication with the injector bore and located intermediate the sleeve injector and the wellbore for receiving the selected sleeve therein, the injector bore and the staging bore forming an axial bore;

an upper isolation tool for fluidly isolating the injector bore from the staging bore, the upper isolation tool comprising a mandrel having at least one annular seal for sealing within the axial bore, wherein the guide rod extends movably through a bore of the mandrel and is sealable therein;

a lower isolation valve for fluidly isolating the staging bore from the wellbore;

a guide rod extending into an uphole end of the injector bore and operable to displace the selected sleeve from the injector bore;

a first port in fluid communication with the staging bore for equalizing pressure between the staging bore and the wellbore; and a fall restrictor means located downhole from a furthest downhole magazine of the at least one magazine for holding the selected sleeve within the injector bore, and preventing premature alignment of a subsequent carrier sleeve with the injector bore.

9. The system of claim 8, further comprising an equalization conduit about the lower isolation valve for fluid communication between the staging bore and the wellbore.

10. The system of claim 8, further comprising a pump for selectably introducing fluid into the staging bore or removing fluid from the staging bore.

11. The system of claim 8, wherein the guide rod comprises an annular swab at a sleeve end of the guide rod for swabbing the axial bore.

12. The system of claim 8, wherein the fall restrictor is an annular restrictor.

13. A method for injecting carrier sleeves into a wellbore, comprising:

aligning a selected sleeve of the carrier sleeves with an injector bore of a sleeve injector;

after aligning the selected sleeve with the injector bore, holding the selected sleeve within the injector bore and preventing said sleeve from falling into a staging bore below the injector bore, the injector bore and the staging bore forming an axial bore;

fluidly connecting the staging bore and the injector bore;

after holding the selected sleeve within the injector bore, displacing the selected sleeve from the injector bore into the staging bore;

fluidly isolating the staging bore from the injector bore comprising inserting an isolation tool mandrel into the axial bore between the staging bore and the injector bore;

pressurizing the staging bore; and fluidly connecting the staging bore to the wellbore to drop the selected sleeve into the wellbore.

14. The method of claim 13, wherein the displacing the selected sleeve comprises mechanically engaging the selected sleeve to forcibly launch the selected sleeve into the staging bore.

15. The method of claim 14, wherein the mechanically engaging the selected sleeve to forcibly launch the selected sleeve further comprises extending a guide rod into the injection bore for displacing the selected sleeve and blocking the injection bore to prevent the aligning of a subsequent carrier sleeve.

16. The method of claim 13, wherein the fluidly isolating of the staging bore from the injector bore comprises sealing the axial bore between the staging bore and the injector bore with an upper isolation valve.

* * * * *